US009341990B2

(12) United States Patent
Hasegawa

(10) Patent No.: US 9,341,990 B2
(45) Date of Patent: May 17, 2016

(54) TRANSFER UNIT AND IMAGE FORMING APPARATUS INCLUDING SAME

(71) Applicant: Ryo Hasegawa, Kanagawa (JP)

(72) Inventor: Ryo Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/851,101

(22) Filed: Sep. 11, 2015

(65) Prior Publication Data

US 2016/0103404 A1 Apr. 14, 2016

(30) Foreign Application Priority Data

Oct. 8, 2014 (JP) ..... 2014-207546

(51) Int. Cl.
*G03G 15/08* (2006.01)
*G03G 15/16* (2006.01)
*G03G 15/01* (2006.01)

(52) U.S. Cl.
CPC ..... *G03G 15/161* (2013.01); *G03G 15/0136* (2013.01); *G03G 2215/0193* (2013.01)

(58) Field of Classification Search
CPC ..... G03G 15/0136; G03G 15/161; G03G 2215/0193
See application file for complete search history.

(56) References Cited

U.S. PATENT DOCUMENTS 6,324,374 B1 * 11/2001 Sasamoto ..... G03G 15/0131 399/101
6,571,073 B1 * 5/2003 Suzuki ..... G03G 21/1619 399/116
7,941,074 B2 * 5/2011 Nakagaki ..... G03G 15/161 399/121
8,103,189 B2 * 1/2012 Maeda ..... G03G 15/1685 399/121
2006/0072929 A1 * 4/2006 Takahashi ..... G03G 21/1647 399/13
2007/0231000 A1 * 10/2007 Otake ..... G03G 21/1623 399/121
2007/0286628 A1 * 12/2007 Kayahara ..... G03G 15/1605 399/66
2008/0095556 A1 * 4/2008 Mochizuki ..... G03G 15/1605 399/308
2008/0247792 A1 * 10/2008 Kubo ..... G03G 15/161 399/377
2009/0017953 A1 * 1/2009 Uehara ..... G03G 15/1615 475/149
2009/0110436 A1 * 4/2009 Sugiyama ..... G03G 15/161 399/121
2009/0190971 A1 * 7/2009 Inui ..... G03G 15/0131 399/299
2009/0245864 A1 * 10/2009 Nakura ..... G03G 15/0131 399/121

(Continued)

FOREIGN PATENT DOCUMENTS

JP 2013-195730 9/2013

OTHER PUBLICATIONS

U.S. Appl. No. 14/712,307, filed May 14, 2015.

(Continued)

*Primary Examiner* — David Bolduc
(74) *Attorney, Agent, or Firm* — Oblon, McClelland, Maier & Neustadt, L.L.P.

(57) ABSTRACT

A transfer unit detachably mountable relative to an image forming apparatus includes a plurality of rotational supports, an endless-looped belt disposed opposite to an image bearer and movably supported by the plurality of rotational support to contact the image bearer to form a transfer portion at which the toner image is transferred, a contact-and-separation device to move the belt to contact and separate from the image bearer, a base to support the plurality of rotational supports, a belt pressing member disposed facing the belt and detachably mountable relative to the base to contact an end portion of the belt, and a first stopper to prevent the belt pressing member from separating from the base while the belt is in contact with the image bearer by the contact-and-separation device and to allow the belt pressing member to separate from the base while the belt is separated from the image bearer.

14 Claims, 22 Drawing Sheets

(56) References Cited

U.S. PATENT DOCUMENTS

2010/0008689 A1* 1/2010 Iwasaki ..... G03G 15/167 399/66
2010/0080625 A1* 4/2010 Furuya ..... G03G 21/1623 399/121
2010/0098465 A1* 4/2010 Saito ..... G03G 15/161 399/297
2010/0158566 A1* 6/2010 Choi ..... G03G 15/0131 399/121
2010/0247144 A1* 9/2010 Kaneyama ..... G03G 15/161 399/121
2010/0247170 A1* 9/2010 Nakamura ..... G03G 15/161 399/302
2011/0058859 A1* 3/2011 Nakamatsu ..... G03G 15/161 399/299
2011/0064487 A1* 3/2011 Ichihashi ..... G03G 15/161 399/302
2011/0249986 A1* 10/2011 Nakano ..... G03G 15/161 399/121
2012/0057908 A1* 3/2012 Meguro ..... F16H 7/0827 399/313
2012/0237260 A1* 9/2012 Sengoku ..... G03G 15/161 399/162
2013/0061698 A1* 3/2013 Izumi ..... G03G 15/0136 74/55
2013/0064572 A1* 3/2013 Shiba ..... G03G 15/0189 399/121
2013/0243444 A1* 9/2013 Karasawa ..... G03G 21/1671 399/13
2014/0126931 A1* 5/2014 Sato ..... G03G 21/1647 399/121
2014/0147145 A1* 5/2014 Yoshioka ..... G03G 15/1675 399/66
2014/0153945 A1* 6/2014 Yoshioka ..... G03G 15/1615 399/66
2014/0328604 A1 11/2014 Tanaka et al.
2015/0268591 A1* 9/2015 Fujita ..... G03G 15/1615 399/121
2015/0309447 A1* 10/2015 Suzuki ..... G03G 15/1605 399/121

OTHER PUBLICATIONS

U.S. Appl. No. 14/723,767, filed May 28, 2015.

* cited by examiner

TRANSFER UNIT AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application No. 2014-207546, filed on Oct. 18, 2014, in the Japan Patent Office, the entire disclosure of which is hereby incorporated by reference herein.

BACKGROUND

1. Technical Field

Exemplary aspects of the present invention generally relate to an image forming apparatus, such as a copier, a facsimile machine, a printer, or a multi-functional system including a combination thereof, and more particularly to, a transfer unit employed in the image forming apparatus.

2. Description of the Related Art

There are known image forming apparatuses equipped with a transfer unit including a looped belt to transfer an image or to transport a recording medium onto which an image is transferred. The belt is looped around a plurality of rotational supports and is disposed opposite an image bearer. The transfer unit is movable by a contact-and-separation device such that the belt can contact and separate from the image bearer. During transfer of an image, the transfer unit is situated at a position at which the belt can contact the image bearer. When an image is not formed or the transfer unit is detached from the image forming apparatus, the belt is separated from the image bearer.

In such a configuration, deformation and vibration of the belt cause misalignment of the belt and the image bearer. In order to prevent the positional relations of the belt and the image bearer from changing, for example, an end portion of the surface of the belt is pressed from above by a belt pressing member.

Because the belt pressing member contacts the belt upon image transfer, the belt pressing member is fixated, in general. There is a drawback to this configuration in that when the belt is separated from the image bearer to separate the transfer unit from the image forming apparatus but the belt pressing member is fixated, the separated belt and the belt pressing member interfere with each other.

SUMMARY

In view of the foregoing, in an aspect of this disclosure, there is provided an improved transfer unit detachably mountable relative to an image forming apparatus having an image bearer that bears a toner image. The transfer unit includes a plurality of rotational supports, an endless-looped belt, a contact-and-separation device, a base, a belt pressing member, and a first stopper. The endless-looped belt is disposed opposite to the image bearer and movably supported by the plurality of rotational support, and contacts the image bearer to form a transfer portion at which the toner image is transferred. The contact-and-separation device moves the belt to contact and separate from the image bearer. The base supports the plurality of rotational supports. The belt pressing member is disposed facing the belt and detachably mountable relative to the base, and contacts an end portion of the belt. The first stopper prevents the belt pressing member from separating from the base while the belt is in contact with the image bearer by the contact-and-separation device and allows the belt pressing member to separate from the base while the belt is separated from the image bearer.

According to another aspect, an image forming apparatus includes an image bearer to bear a toner image, and the transfer unit to transfer the toner image borne on the image bearer to a transfer medium.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
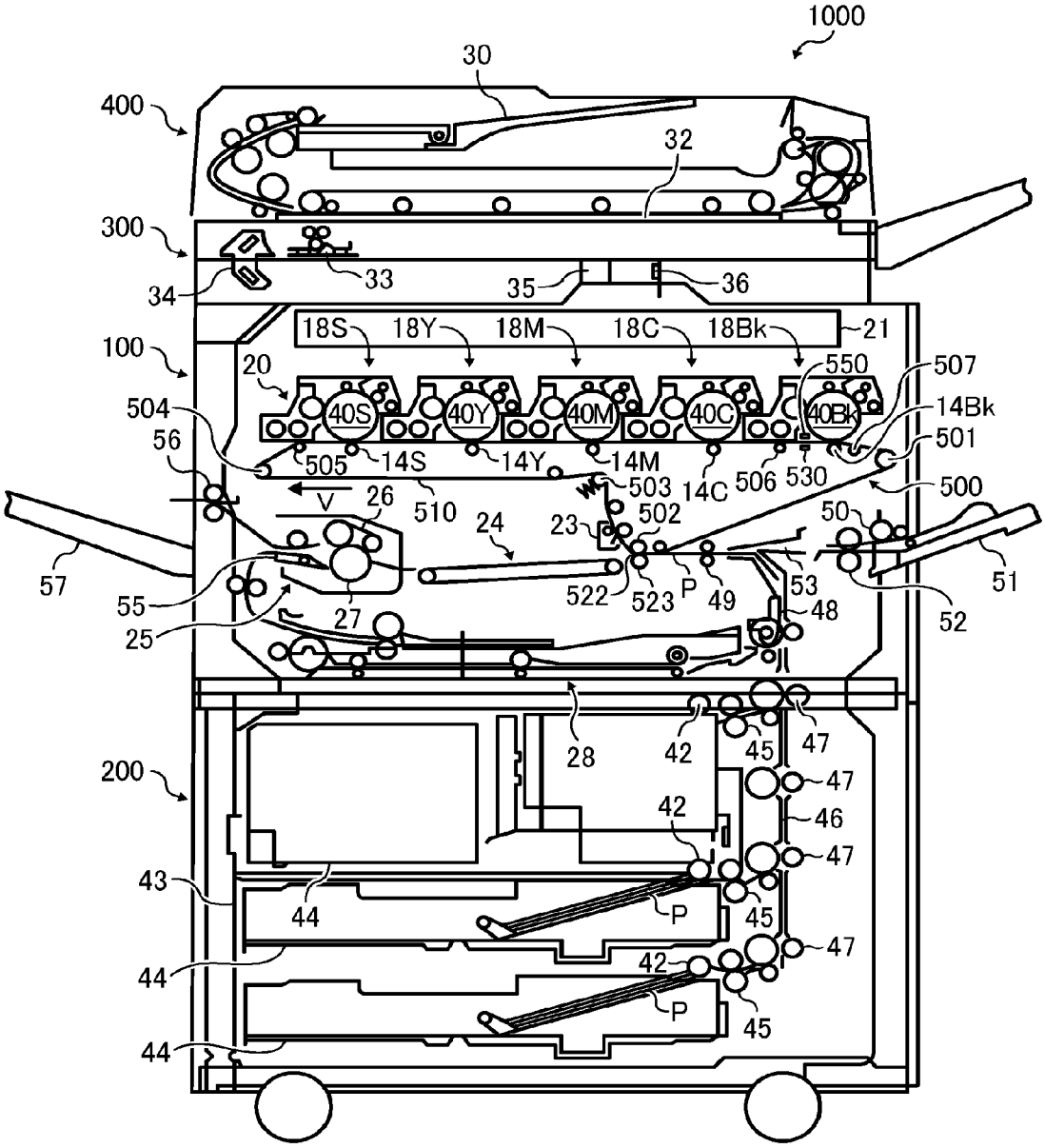
FIG. 1 is a schematic diagram illustrating an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

In order to facilitate an understanding of the novel features of the present invention, as a comparison, a description is provided of a known image forming apparatus.

Referring now to the drawings, wherein like reference numerals designate identical or corresponding parts throughout the several views, exemplary embodiments of the present patent application are described.

With reference to FIG. 1, a description is provided of the image forming apparatus according to an illustrative embodiment of the present disclosure. The same reference numerals will be given to constituent elements such as parts and materials having the same functions, and the descriptions thereof will be omitted.

According to an illustrative embodiment of the present disclosure, a belt and a belt pressing member are detachably attachable relative to a transfer device while the belt and the belt pressing member are separated from an image bearer.

FIG. 1 is a schematic diagram illustrating a color copier as an example of an image forming apparatus according to an illustrative embodiment of the present disclosure. An image forming apparatus 1000 includes a main body 100, a paper feed table 200 disposed below the main body 100, a scanner 300 disposed above the main body 100, and an automatic document feeder (ADF) 400 disposed above the scanner 300. The image forming apparatus 1000 is not necessarily equipped with the ADF 400. The present disclosure can be applied to the image forming apparatus without the ADF 400.

The main body 100 houses a transfer unit 500 substantially at the center of the main body 100. The transfer unit 500 includes a transfer belt 510 as an intermediate transfer body formed into an endless loop. The transfer unit 500 is detachably mountable relative to the main body 100 from the proximal side of the main body 100 (from a perpendicular direction relative to the drawing surface). The intermediate transfer belt 510 is looped around a plurality of rollers 501 through 507, and is movable in a clockwise direction indicated by an arrow V in FIG. 1. The arrow V indicates a traveling direction of the transfer belt 510.

A transfer cleaning device 23 is disposed near the transfer belt 510 to remove residual toner remaining on the transfer belt 510 after transfer of an image. The image forming apparatus 1000 includes process cartridges 18S, 18Y, 18M, 18C, and 18BkBk arranged in tandem (horizontally) in this order from the upstream side in the traveling direction V of the transfer belt 510. The process cartridges 18S, 18Y, 18M, 18C, and 18BkBk correspond to five colors, i.e., a special color, yellow, magenta, cyan, and black, respectively. It is to be noted that suffixes S, Y, M, C, and Bk denote the colors i.e., special color, yellow, magenta, cyan, and black, respectively. To simplify the description, the reference characters S, Y, M, C, and Bk indicating colors are omitted herein unless otherwise specified.

The process cartridges 18S, 18Y, 18M, 18C, and 18BkBk constitute a tandem image forming unit 20. An exposure unit 21 is disposed above the tandem image forming unit 20. The process cartridges 18S, 18Y, 18M, 18C, and 18BkBk include drum-shaped photoconductors 40S, 40Y, 40M, 40C, and 40BkBk, respectively. The photoconductors 40S, 40Y, 40M, 40C, and 40Bk serve as image bearing members. Each of the process cartridges 18S, 18Y, 18M, 18C, and 18Bk includes a toner image forming function and a photoconductor cleaning function. The toner image forming device forms on the photoconductor a toner image with toner as a developer of respective color using a known electrophotographic process. The photoconductor cleaning device cleans the surface of the photoconductor after transfer of the toner image.

Each of the process cartridges 18S, 18Y, 18M, 18C, and 18Bk, and the transfer unit 500 are detachably and mountably held relative to the main body 100. According to the present illustrative embodiment, the direction in which the process cartridges 18S, 18Y, 18M, 18C, and 18Bk, and the transfer unit 500 are pulled towards the front (proximal) side of the image forming apparatus 1000 coincides with a separation direction. The direction in which the process cartridges 18S, 18Y, 18M, 18C, and 18Bk, and the transfer unit 500 are pushed inward from the front (proximal) side of the image forming apparatus 1000 to the distal side coincides with a mounting direction.

The special color includes, but is not limited to, a special color other than primary colors such as yellow, cyan, magenta, and black, a metal color toner, a transparent toner, a foam toner, a fluorescent toner, and a spot color. According to the present illustrative embodiment, the special color also refers to a white color and/or a transparent color (gloss coating). A white toner is used for the white color. A clear toner is used for the transparent color.

A secondary transfer roller 523 serving as a secondary transfer device is disposed opposite to the tandem image forming unit 20 via the intermediate transfer belt 510. The secondary transfer roller 523 is pressed against a support roller 502 via the transfer belt 510, thereby forming a contact portion referred to as a secondary transfer portion 522. The support roller 502 supports the transfer belt 510 from inside the loop formed by the transfer belt 510. A secondary transfer bias is applied to the secondary transfer portion 522 to transfer a toner image from the transfer belt 510 onto the recording medium P. A conveyor unit 24 and a fixing unit 25 are disposed downstream from the secondary transfer roller 523 in the traveling direction V of the transfer belt 510 or the direction of sheet delivery.

The fixing unit 25 fixes the toner image transferred onto the recording medium P. The fixing unit 25 includes a fixing belt 26 and a pressing roller 27. The fixing belt 26 serves as a fixing device and is looped around a plurality of rollers. The pressing roller 27 serves as a pressing device and is pressed against the fixing belt 26. The conveyor unit 24 transports the recording medium P to the fixing unit 25 after transfer. The toner image transferred on the recording medium P is fixed in the fixing unit 25.

According to the present illustrative embodiment, the image forming apparatus 1000 employs a contact-type transfer method in which the secondary transfer roller 523 serving as a secondary transfer device contacts the transfer belt 510. Alternatively, a contact-free charger may be employed as a secondary transfer device.

A sheet reversing device 28 that reverses a recording medium P upside down to form an image on both sides of the recording medium P is disposed below the secondary transfer portion 522 and the fixing unit 25, and is in parallel with the tandem image forming unit 20. According to the present illustrative embodiment, the image forming apparatus 1000 accommodates double sided printing. In a case in which only a single sided printing is necessitated, the image forming apparatus 1000 does not need to include the sheet reversing device 28.

The image forming apparatus 1000 may function as a printer connected wirelessly or via a cable to external devices such as a personal computer (PC). The image forming apparatus 1000 of the present disclosure is not limited to a color copier and a printer. The image forming apparatus 1000 includes, but is not limited to, an electrophotographic facsimile machine or a multi-functional system including at least two of a copier, a printer, a facsimile machine, and so forth. According to the present illustrative embodiment, the image forming apparatus 1000 is not limited to an image forming apparatus of an electrophotography type. In some embodiments, the image forming apparatus is of an ink-jet type in which ink is ejected to form an image.

The image forming apparatus 1000 is capable of forming images in a full color mode, a black mode, a special color mode, and a combination mode. More specifically, in the full color mode an image is formed using toners in four colors:

black, cyan, magenta, and yellow. In the black mode, an image is formed using only a black toner. In the special color mode, an image is formed using only a special color toner. In the combination mode, an image is formed in both the full color mode and the special color mode.

For example, when making a color copy in the full color mode, a color document is placed on a document table 30. Alternatively, a document is set on a contact glass 32 of the scanner 300 while the automatic document feeder 400 is lifted up, followed by holding down the automatic document feeder 400.

Upon switching on the image forming apparatus 1000, in a case in which a document is set in the automatic document feeder 400, the scanner 300 is driven to move a first carriage 33 and a second carriage 34 immediately after the document is delivered onto the contact glass 32. In a case in which a document is set on the contact glass 32, the scanner 300 is driven immediately to move the first carriage 33 and the second carriage 34. In the image forming apparatus 1000, the first carriage 33 directs light from a light source to a document and reflects light reflected from the document toward the second carriage 34. A mirror of the second carriage 34 reflects the light toward a reading sensor 36 through an imaging lens 35. The document is read accordingly.

Upon switching on the image forming apparatus 1000, the transfer belt 510 is rotated by a drive motor in the clockwise direction in FIG. 1. In the image forming apparatus 1000, when switching on the image forming apparatus 1000, the photoconductors 40Bk, 40C, 40M, and 40Y of the process cartridges 18Bk, 18C, 18M, and 18Y are rotated, and single-color toner images of black, cyan, magenta, and yellow are formed on the respective photoconductors 40Bk, 40C, 40M, and 40Y. The single-color toner images are sequentially transferred onto the transfer belt 510 as the transfer belt 510 travels. As a result, a composite full-color toner image is formed on the transfer belt 510.

In the meantime, upon switching on the image forming apparatus 1000, one of feed rollers 42 of the paper feed table 200 is selectively rotated so that a sheet of a recording medium P is fed from one of paper cassettes 44 in a paper bank 43. The recording medium P picked up by the feed roller 42 is fed to a sheet passage 46 one by one by a separation roller 45. Subsequently, the recording medium P is delivered to a sheet passage 48 in the main body 100 by conveyor rollers 47 and then contacts a registration roller 49. The recording medium P stops temporarily. Alternatively, the recording medium P is fed from a side tray 51 by rotating a feed roller 50, separated by a separation roller 52, fed to a manual feed path 53, and stopped by the registration roller 49. The registration roller 49 is rotated to feed the recording medium P in appropriate timing such that the recording medium P is aligned with the composite color image on the transfer belt 510 arriving at the secondary transfer portion 522. The recording medium P is fed to the secondary transfer portion 522 between the transfer belt 510 and the secondary transfer roller 523. The composite color toner image is transferred onto the recording medium P at the secondary transfer portion 522. When forming a single-color image, the single-color toner image is formed and transferred onto the transfer belt 510. Subsequently, the toner image is transferred onto a recording medium P at the secondary transfer portion 522.

After the toner image is transferred onto the recording medium P, the recording medium P is delivered from the secondary transfer portion 522 to the fixing unit 25. In the fixing unit 25, heat and pressure are applied to the recording medium P to fix the toner image on the recording medium P. In the case of single-sided printing, after fixing, a switch claw 55 directs the recording medium P to a paper ejection roller 56, and the recording medium P is output onto a catch tray 57 by the paper ejection roller 56. In the case of double-sided printing, the switch claw 55 switches a paper feed path to direct the recording medium to a sheet reversing device 28 in which the recording medium P is reversed and is fed to the secondary transfer portion 522 again, thereby transferring a toner image on the back of the recording medium P. Subsequently, the recording medium P is output onto the catch tray 57.

After the transfer process, the transfer cleaning device 23 removes residual toner remaining on the transfer belt 510, in preparation for the subsequent imaging cycle in the tandem image forming unit 20.

Figure 2:
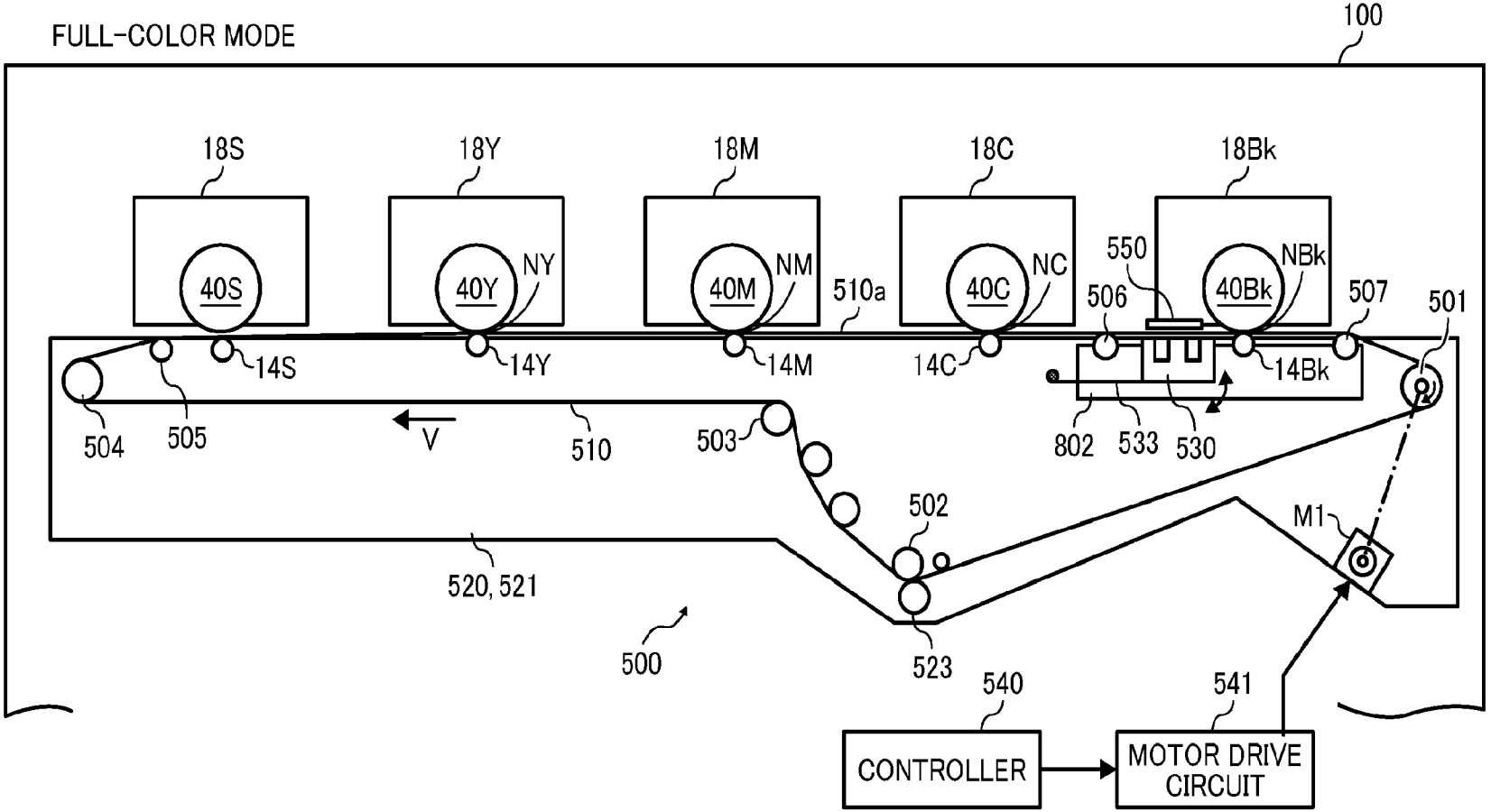
FIG. 2 is an enlarged view schematically illustrating a belt and a primary transfer device of a transfer unit employed in the image forming apparatus of FIG. 1 in full color mode.

With reference to FIG. 2, a description is provided of the transfer unit 500 according to an illustrative embodiment of the present disclosure.

FIG. 2 is a schematic diagram illustrating the process cartridges 18S, 18Y, 18M, 18C, and 18Bk, and the transfer unit 500 as viewed from the front (proximal) side of the image forming apparatus 1000. In FIG. 2, the transfer unit 500 includes the transfer belt 510 looped around rollers 501 through 507, a scale unit 530 serving as a scale detection assembly, and a belt pressing member 550. The plurality of rollers 501, 502, 503, 504, 505, 506, and 507 is rotatably supported by lateral plates 520 and 521 serving as a base of the transfer unit 500. According to the present illustrative embodiment, the lateral plate 520 is disposed at the back (distal) side of the main body 100. The lateral plate 521 is disposed at the front (proximal) side of the main body 100, facing the lateral plate 520. The lateral plates 520 and 521 are disposed facing each other. Depending on the direction of the view, the drawings may only show one of the lateral plates 520 and 521.

The roller 501 is a drive roller. The roller 502 serves as a secondary-transfer opposed roller. The roller 501 is disposed substantially at the right end side of the main body 100. The roller 504 is disposed substantially at the left end side of the main body 100. The roller 502 is disposed lower than the rollers 501 and 504. The rollers 505, 506, and 507 are disposed spaced apart a certain distance from the upstream side to the downstream side in the traveling direction V of the transfer belt 510 above the rollers 501 and 504. The transfer belt 510 looped around these rollers is tensioned substantially horizontally between the rollers 505 and 507. A belt surface 510*a* faces the photoconductors 40S, 40Y, 40M, 40C, and 40Bk of the process cartridges 18S, 18Y, 18M, 18C, and 18Bk. The bet surface 510*a* constitutes a transfer surface onto which toner images are transferred.

The roller 503 between the roller 502 and the roller 504 serves as a tension roller that presses the transfer belt 510 from the outside of the loop of the transfer belt 510 towards the inside. The roller 505 between the roller 504 and a primary transfer roller 14S serves as a tension roller that presses the transfer belt 510 from the inside of the loop of the transfer belt 510 towards the outside. The roller 507 between the roller 506 and the roller 501 serves as a tension roller that presses the transfer belt 510 from the inside of the loop of the transfer belt 510 towards the outside. The roller 501 is rotated in a counterclockwise direction by a drive motor M1. As the drive motor M1 is rotatably driven, the transfer belt 510 is moved in the clockwise direction in FIG. 2. As illustrated in FIG. 2, the drive motor M1 is connected to a motor drive circuit 541 via signal lines. The motor drive circuit 541 is connected to a controller 540 via signal lines. The controller 540 turns on and off driving of the drive motor M1 via the motor drive circuit 541. As will be described later in detail, the controller 540 also turns on and off driving of contact-and-separation devices 600 through 800.

Primary transfer rollers 14S, 14Y, 14M, 14C, and 14Bk serving as primary transfer devices are disposed inside the looped transfer belt 510 and facing the photoconductors 40S, 40Y, 40M, 40C, and 40Bk, respectively. The primary transfer rollers 14S, 14Y, 14M, 14C, and 14Bk are movable by the later-described contact-and-separation devices between a contact position and a separation position. More specifically, when the primary transfer rollers 14S, 14Y, 14M, 14C, and 14Bk are situated at the contact position, the belt surface 510*a* of the transfer belt 510 contacts the photoconductors 40S, 40Y, 40M, 40C, and 40Bk. When the primary transfer rollers 14S, 14Y, 14M, 14C, and 14Bk are situated at the separation position, the belt surface 510*a* separates from the photoconductors 40S, 40Y, 40M, 40C, and 40Bk. The transfer belt 510 contacts the surface of the photoconductors 40S, 40Y, 40M, 40C, and 40Bk, thereby forming transfer portions NS, NY, NC, NM, and NBk at which toner images are transferred onto the transfer belt 510.

The separation position is a position when the transfer unit 500 is detached and mounted relative to the main body 100 of the transfer unit 500 in the separation mode. The contact position includes positions in the black mode (first mode) in which an image is formed with only the black toner, in the full color mode (second mode) in which an image is formed with the black, cyan, magenta, and yellow toners, in the combination mode (third mode) in which an image is formed with the special color toner, and the black, cyan, magenta, and yellow toners, and in the special color mode (fourth mode) in which an image is formed with only the special color toner. Contact and separation movement of the contact-and-separation device changes the position of the primary transfer rollers 14Bk, 14M, 14Y, 14C, and 14S in the first mode through the fourth mode, and in the separation mode.

FIG. 2 illustrates positional relations between the transfer belt 510, the primary transfer rollers 14S, 14Y, 14M, 14C, and 14Bk, and the rollers 505 through 507 in the full color mode. According to the present illustrative embodiment, in the full color mode, the primary transfer rollers 14Y, 14M, 14C, and 14Bk, and the rollers 506 and 507 are situated at the contact position while the primary transfer roller 14S and the roller 505 are situated at the separation position. In this configuration, the belt surface 510*a* is in contact with the photoconductors 40Y, 40M, 40C, and 40Bk. The transfer portions NY, NC, NM, and NBk, at which the photoconductors contact the belt surface 510*a* and the toner images on the photoconductors are transferred onto the belt surface 510*a*, are formed. Among these transfer portions, the transfer portion at which the photoconductor 40Bk and the belt surface 510*a* contact is hereinafter referred to as a black transfer portion NBk. The roller 506 constitutes an arbitrary rotary support.

Figure 3:
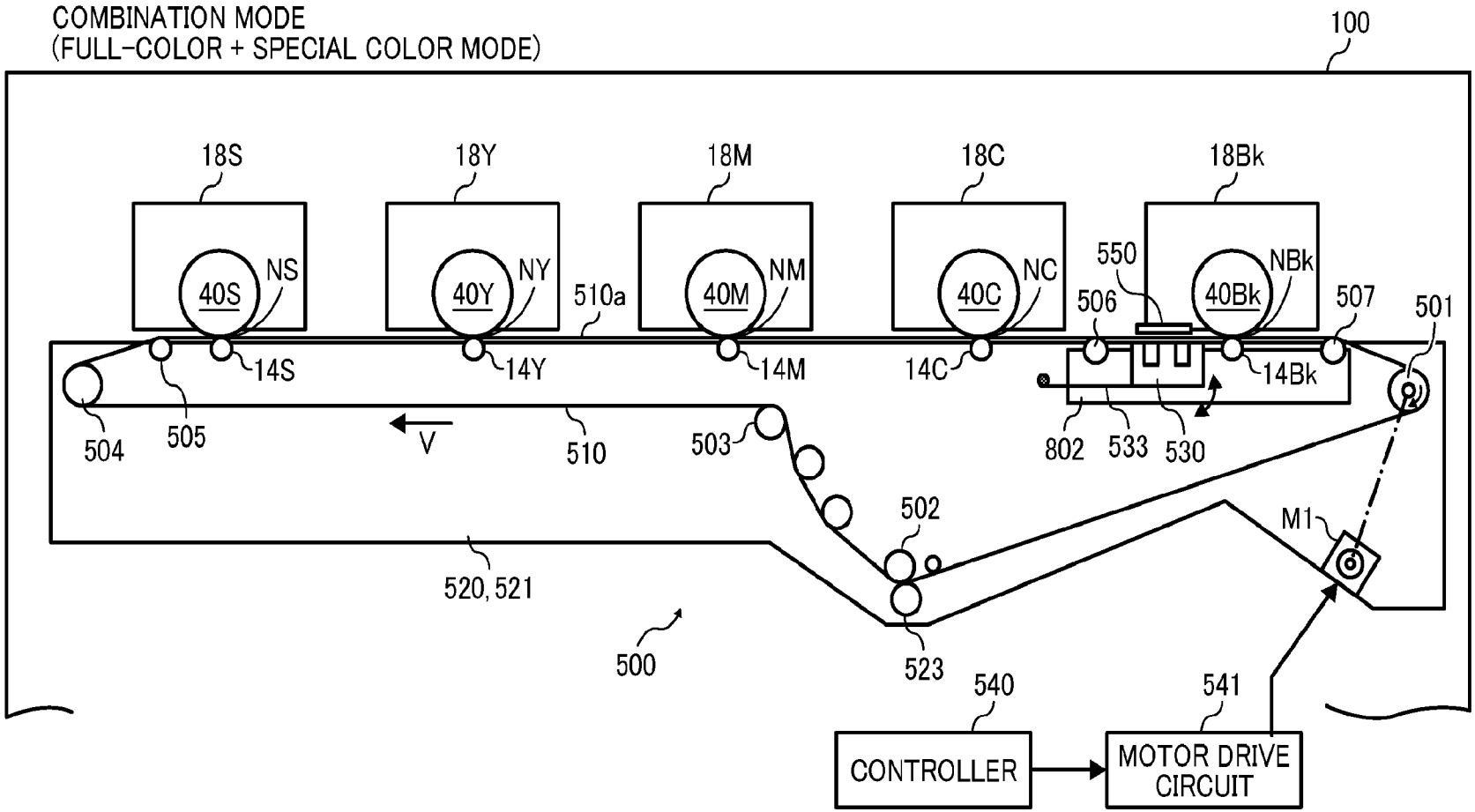
FIG. 3 is an enlarged view schematically illustrating the belt and the primary transfer device of the transfer unit in combination mode (full color & special color mode)

FIG. 3 illustrates positional relations between the transfer belt 510, the primary transfer rollers 14S, 14Y, 14M, 14C, and 14Bk, and the rollers 505 through 507 in the combination mode. According to the present illustrative embodiment, in the combination mode, the primary transfer rollers 14S, 14Y, 14M, 14C, and 14Bk, and the rollers 505 and 507 are situated at the contact position. In this configuration, the belt surface 510*a* of the transfer belt 510 is in contact with all the photoconductors 40S, 40Y, 40M, 40C, and 40Bk.

Figure 4:
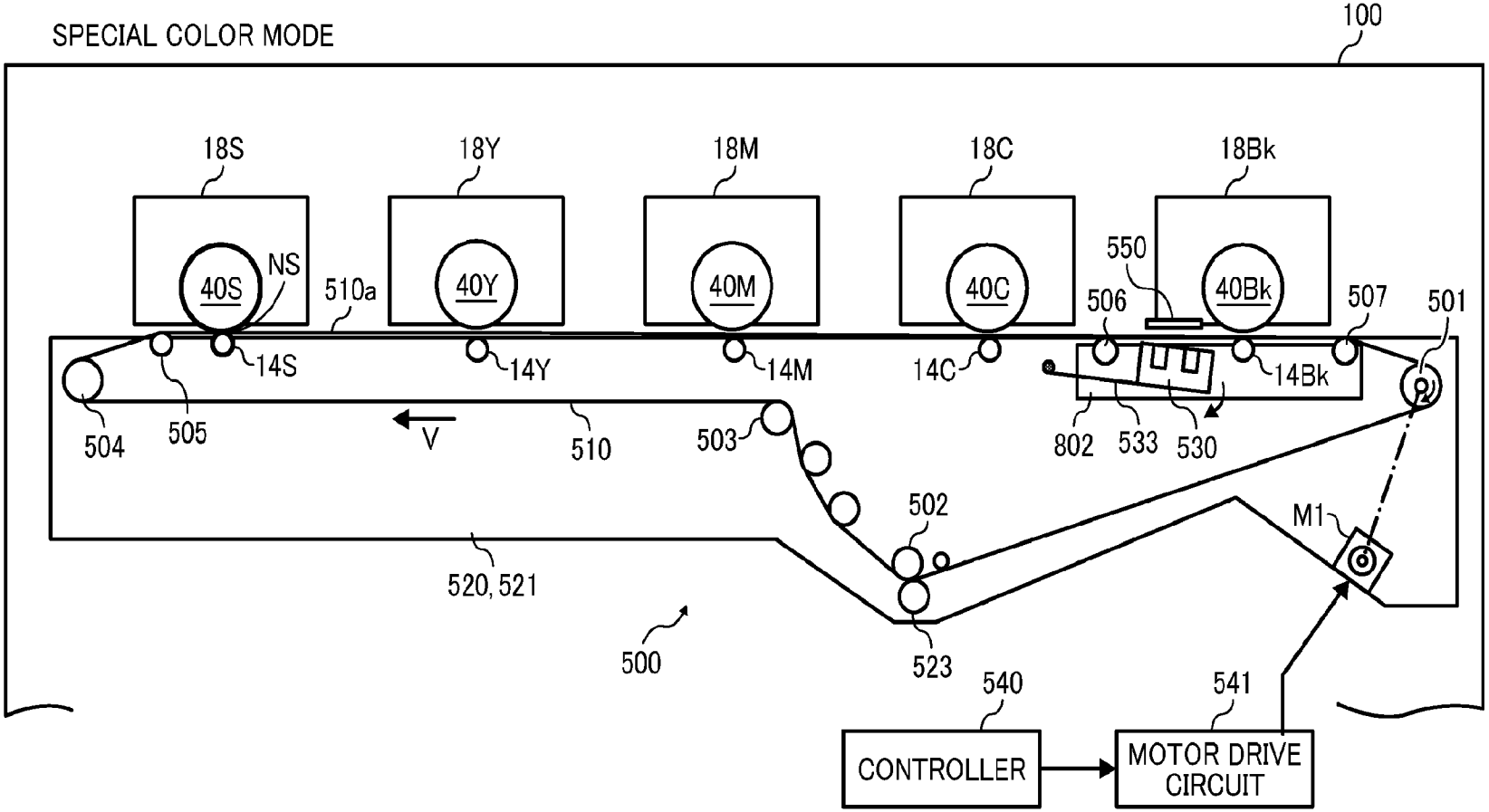
FIG. 4 is an enlarged view schematically illustrating the belt and the primary transfer device of the transfer unit in special color mode.

FIG. 4 illustrates positional relations between the transfer belt 510, the primary transfer rollers 14S, 14Y, 14M, 14C, and 14Bk, and the rollers 505 through 507 in the special color mode. According to the present illustrative embodiment, in the special color mode, the primary transfer rollers 14Y, 14M, 14C, and 14Bk, and the rollers 506 and 507 are at the separation position while the primary transfer roller 14S and the roller 505 are at the contact position. In this configuration, the belt surface 510*a* of the transfer belt 510 is in contact with the photoconductor 40S.

More specifically, the special color mode is an arbitrary mode in which the belt surface 510*a* of the transfer belt 510 contacts only the photoconductor 40S as an arbitrary image bearer that bears a special color toner image which is a toner image not used in the full color mode.

Figure 5:
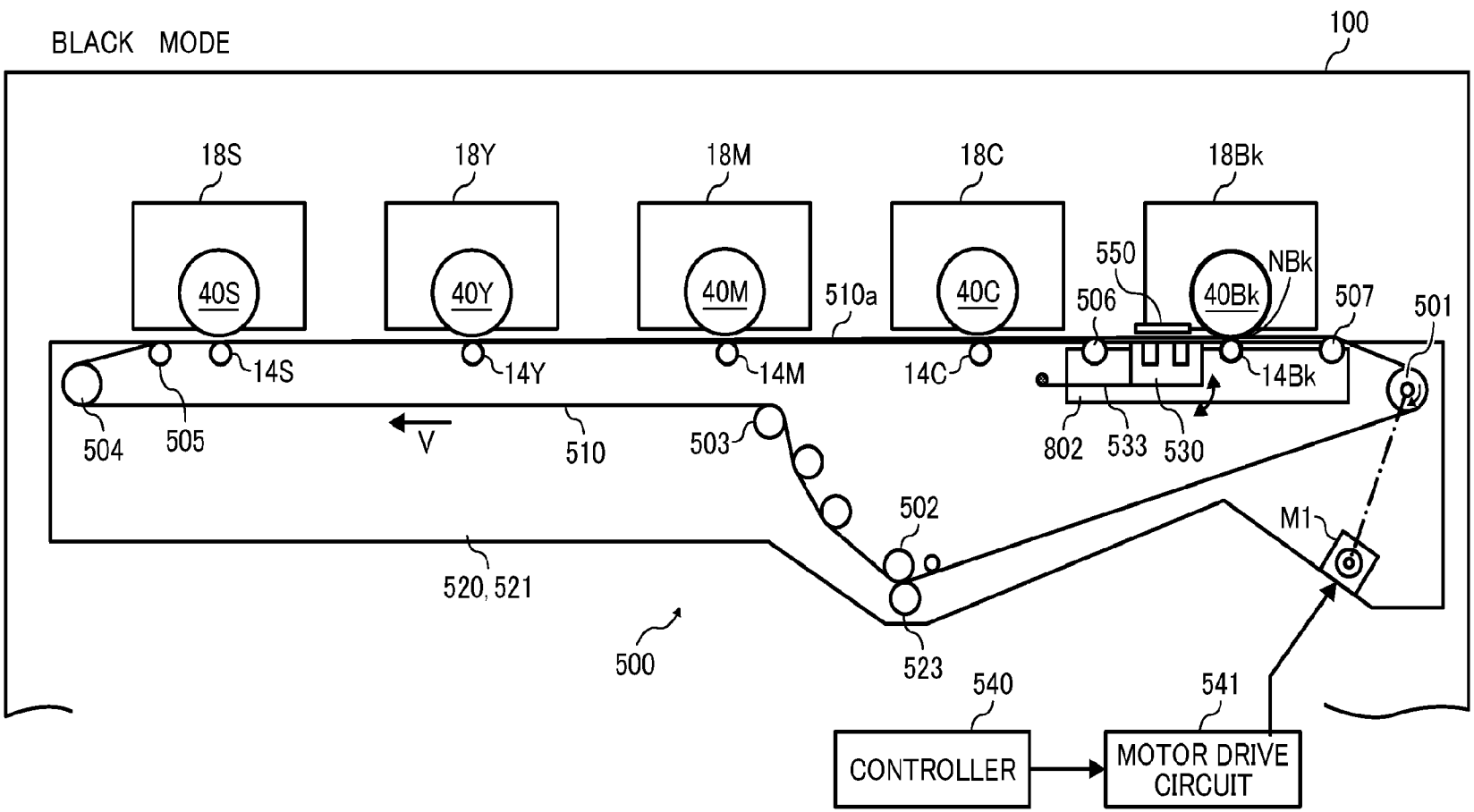
FIG. 5 is an enlarged view schematically illustrating the belt and the primary transfer device of the transfer unit in black mode.

FIG. 5 illustrates positional relations between the transfer belt 510, the primary transfer rollers 14S, 14Y, 14M, 14C, and 14Bk, and the rollers 505 through 507 in the black mode. According to the present illustrative embodiment, in the black mode, the primary transfer roller 14Bk, and the rollers 506 downstream from the primary transfer roller 14Bk and the roller 507 upstream from the primary transfer roller 14Bk in the traveling direction V of the transfer belt 510 are at the contact position while the primary transfer rollers 14S, 14Y, 14M, and 14C, and the roller 505 are at the separation position. In this configuration, the belt surface 510*a* of the transfer belt 510 is in contact with the photoconductor 40Bk.

Figure 6:
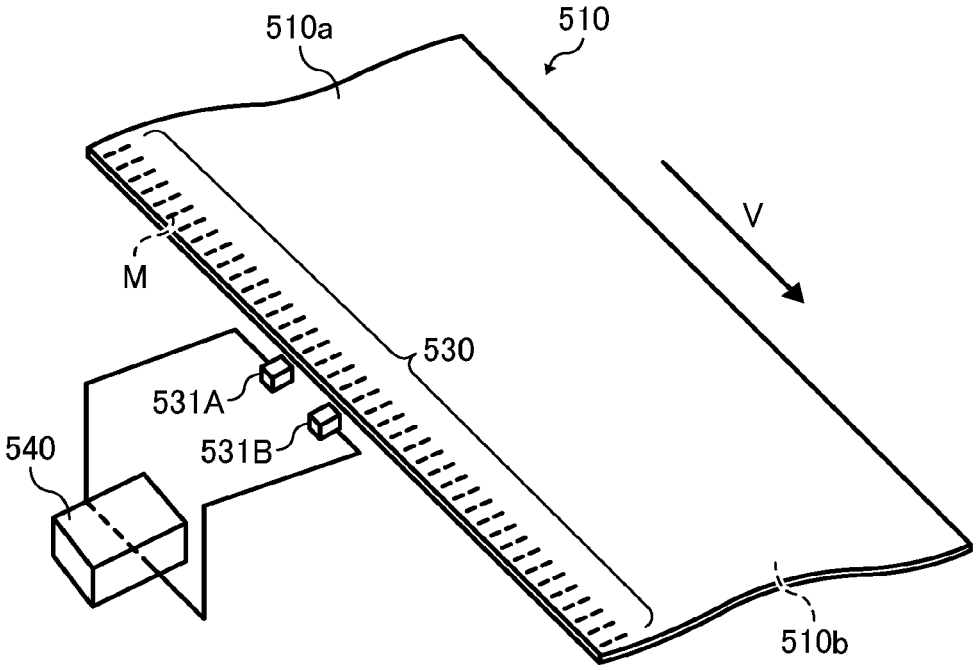
FIG. 6 is a perspective view schematically illustrating a scale mark on the belt and a detector to detect the scale mark.

As illustrated in FIG. 6, the transfer belt 510 includes a plurality of scale marks M successively formed at predetermined intervals (pitches) in the traveling direction V of the transfer belt 510. The plurality of scale marks M are formed along the edge portion of a belt back surface 510*b*, which is an inner circumferential surface of the transfer belt 510. Each of the scale marks M has the same length. The scale marks M are formed parallel with each other and equally spaced. The scale marks M are arranged with very small pitches along the entire circumference of the transfer belt 510 in the traveling direction V of the transfer belt 510. The scale marks M constitute a scale 5 (shown in FIG. 8A) of the transfer belt 510 as a whole.

FIG. 6 illustrates a portion of the scale marks M. The scale marks M are formed with scale marks in a predetermined color. For example, the scale marks M are printed on the transfer belt 510 with an ink or the like having a higher reflectivity than that of the belt surface 510*a* of the transfer belt 510. Alternatively, a tape, on which the scale marks M having a different reflectivity from that of the tape are printed, is adhered to the entire circumference of the transfer belt 510.

The transfer unit 500 includes scale mark detectors 531A and 531B to detect the scale marks M. The scale mark detectors 531A and 531B are disposed below the scale marks M and spaced apart a certain distance. The scale mark detectors 531A and 531B are disposed with a predetermined interval between each other in the traveling direction V of the transfer belt 510. According to the present illustrative embodiment, two scale mark detectors are disposed. However, the number of the scale detectors is not limited to two, and a plurality of scale mark detectors may be disposed. Each of the scale mark detectors 531A and 531B detects sequentially the scale marks M on the transfer belt 510, and outputs detection signals to the controller 540. Based on the detection signals, the controller 540 obtains position data and so forth to calibrate the pitch of the scale marks M, and inputs a target position data and so forth to the motor drive circuit 541 shown in FIG. 2. Accordingly, the traveling speed of the transfer belt 510 is adjusted. Based on the position data of the transfer belt 510 detected by the scale mark detectors 531A and 531B, the controller 540 outputs signals to the motor drive circuit 541 as needed, thereby enabling the motor drive circuit 541 to drive the drive motor M1. Accordingly, the traveling speed of the transfer belt 510 is feedback-controlled.

Figure 7:
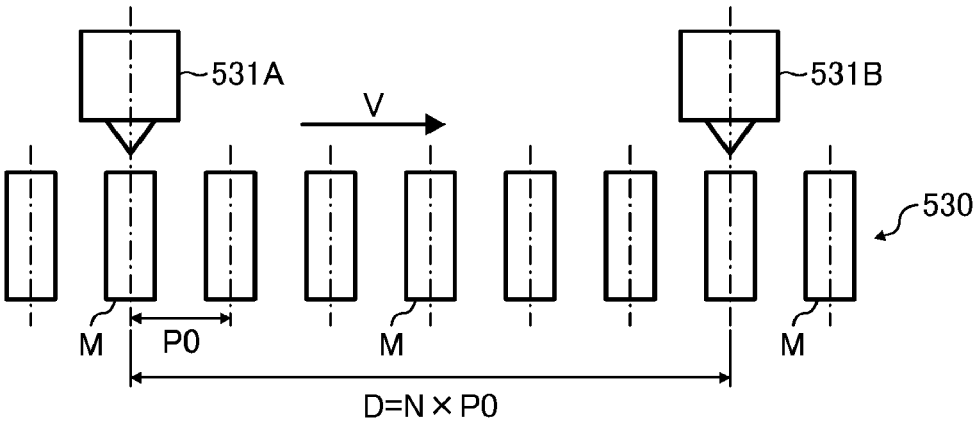
FIG. 7 is a conceptual diagram of the scale mark and the detector for explaining positional relations of the scale mark and the detector.

As illustrated in FIG. 7, according to the present illustrative embodiment, the scale mark detector 531A is disposed upstream from the scale mark detector 531B in the traveling direction V of the transfer belt 510. Each of the scale mark detectors 531A and 531B is capable of detecting all scale marks M. An interval D between a detection point of the scale mark detector 531A and a detection point of the scale mark detector 531B is set to satisfy the following relation: D=N×P0 (N=1, 2, 3, . . . ), where P0 is a design value of a pitch of the scale mark M. The interval D is an integral multiple of P0. When the transfer belt 510 is not deformed (stretched and shrank), the detection points of the scale mark detectors 531A and 531B pass the center of the scale mark M at the same time. As the transfer belt 510 travels, the scale mark detectors 531A and 531B detect sequentially the scale marks M and output detection signals to the controller 540. As will be described later, based on a phase difference and so forth of the detection signals (input signals), the controller 540 feedback-controls the motor drive circuit 541.

Figure 8A:
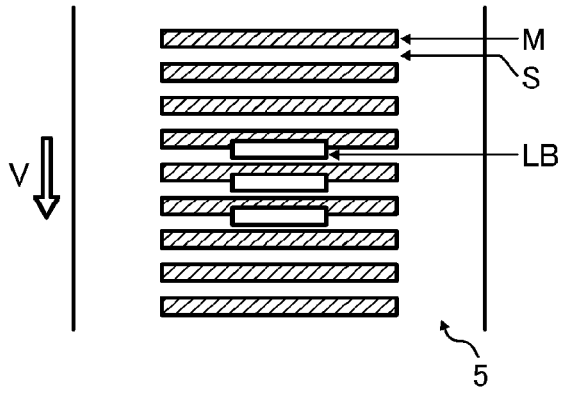
FIGS. 8A through 8C are conceptual diagrams of the scale mark and the detector for explaining detection of the scale mark by the detector.
Figure 8B:
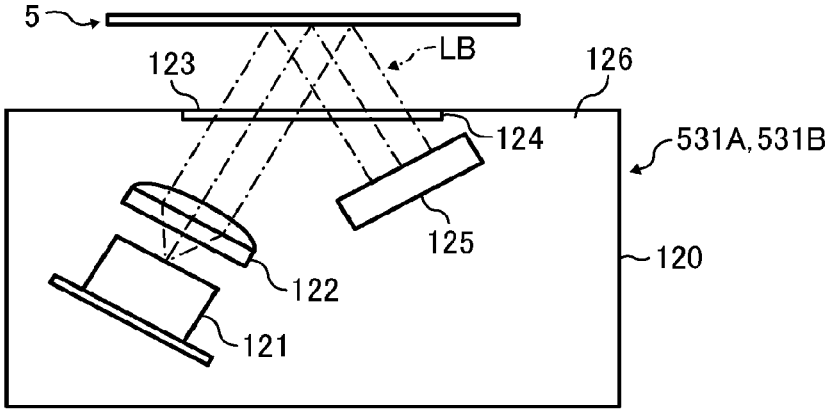
Figure 8C:
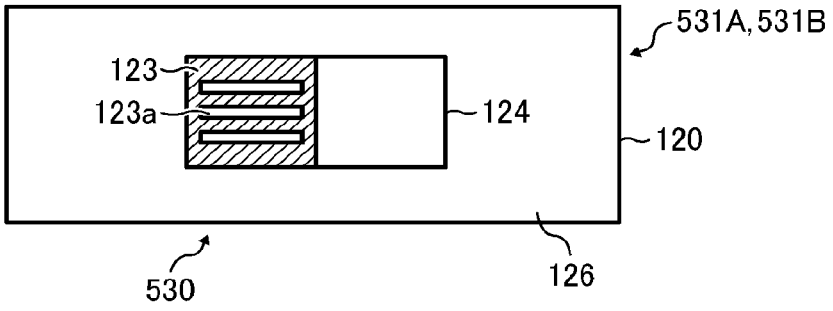

The scale marks M are reflective. As illustrated in FIG. 8A, a reflective portion, that is, the scale mark M, and a shield portion S are alternately formed on the belt back surface 510*b* of the transfer belt 510. As illustrated in FIGS. 8B and 8C, each of the scale mark detectors 531A and 531B includes a light emitting element 121 such as a light emitting diode (LED), a collimator lens 122, a slit mask 123, a light receiving window 124, and a light receiving element 125 such as a phototransistor. These devices are fixed to a detector housing 120. The light receiving window 124 is formed of a transparent cover such as a glass and a transparent resin film.

As the light emitting element 121 serving as a light source of the scale mark detectors 531A and 531B emits light, the light passes through the collimator lens 122 and becomes parallel rays of light. Then, the light passes through a plurality of slits 123*a* of the slit mask 123 parallel with the scale marks M, splitting into a plurality of light beams LB which then irradiate the scale 5 on the transfer belt 510. A portion of the plurality of light beams LB is reflected by the scale marks M. The reflected light passes through the light receiving window 124 and is received by the light receiving element 125. The light receiving element 125 then converts changes in the brightness (intensity) of the reflected light into electrical signals.

As described above, the light receiving element 125 detects the intensity of the reflected light to detect the scale marks M. The scale mark detectors 531A and 531B convert the presence of the scale marks M as the transfer belt 510 travels into a continuously-modulated analog alternating signal. The scale mark detectors 531A and 531B are held by a retainer 126 serving as a detector retainer, thereby constituting the scale unit 530.

Next, with reference to FIGS. 9 through 16, a description is provided of a contact-and-separation device for the primary transfer rollers (transfer belt 510), the belt pressing member 550, and installation of the scale unit 530.

First, with reference to FIGS. 9 through 16, a description is provided of a contact-and-separation device 600 for the primary transfer roller 14S corresponding to the special color, and the roller 505.

Figure 9:
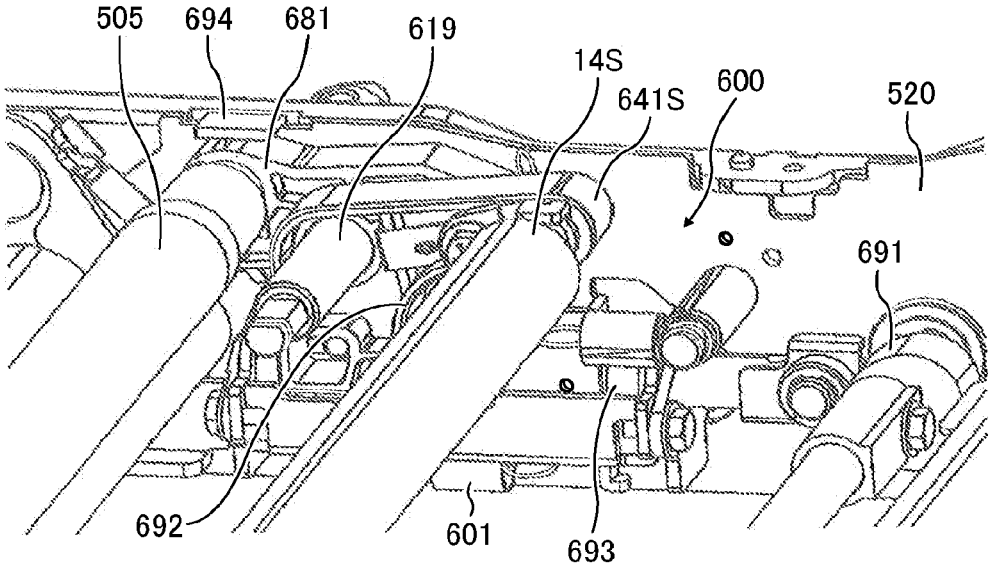
FIG. 9 is a perspective view schematically illustrating a contact-and-separation device for a roller and the primary transfer device facing an arbitrary image bearer corresponding to a special color as viewed diagonally from above.
Figure 10:
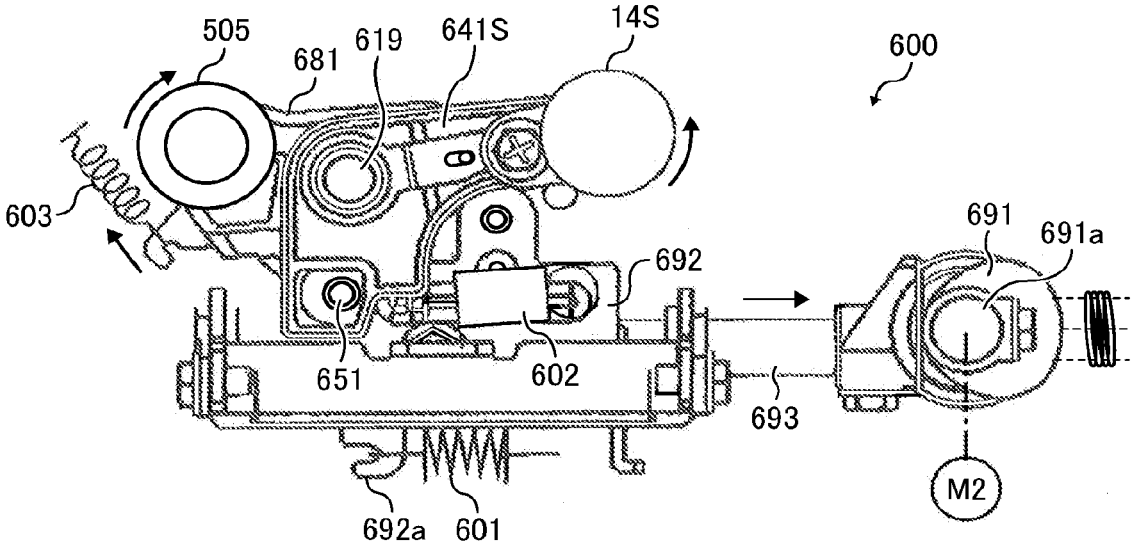
FIG. 10 is a side view schematically illustrating the contact-and-separation device for the roller and the primary transfer device facing the arbitrary image bearer corresponding to the special color in a contact state as viewed from a proximal side of the image forming apparatus.
Figure 11:
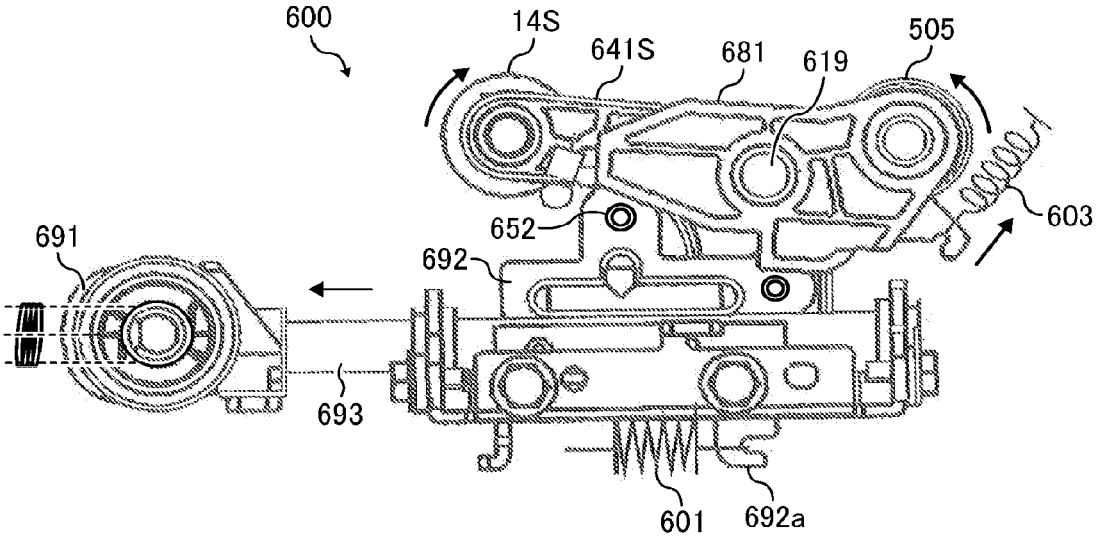
FIG. 11 is a side view schematically illustrating the contact-and-separation device for the roller and the primary transfer device facing the arbitrary image bearer corresponding to the special color in the contact state as viewed from a distal side of the image forming apparatus.
Figure 12:
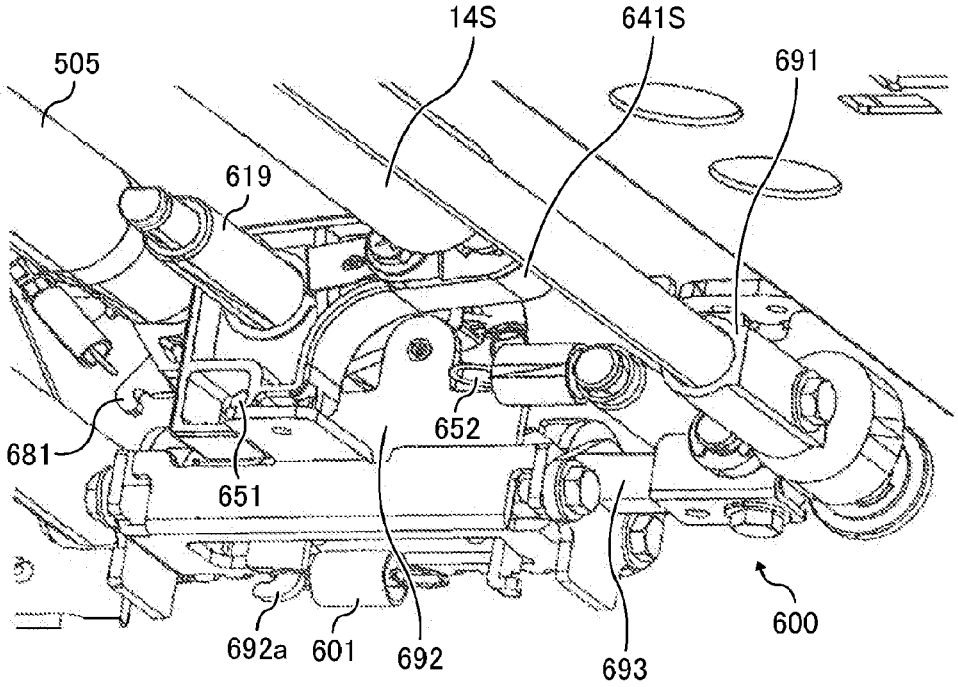
FIG. 12 is a perspective view schematically illustrating the contact-and-separation device for the roller and the primary transfer device facing the arbitrary image bearer corresponding to the special color in the contact state as viewed diagonally from below.

FIG. 9 is a perspective view schematically illustrating the contact-and-separation device 600 for the primary transfer roller 14S and the roller 505 in a contact state, as viewed diagonally from above. FIG. 10 is a side view schematically illustrating the contact-and-separation device 600 in the contact state, as viewed from the front side or the proximal side of the image forming apparatus. FIG. 11 is a side view schematically illustrating the contact-and-separation device 600 in the contact state, as viewed from the back or the distal side of the image forming apparatus. FIG. 12 is a perspective view schematically illustrating the contact-and-separation device 600 in the contact state, as viewed diagonally from below. Although the transfer belt 510 and the photoconductor 40S are not illustrated in FIGS. 9 through 12, the transfer belt 510 and the photoconductor 40S are in contact with each other (in the contact state).

Figure 13:
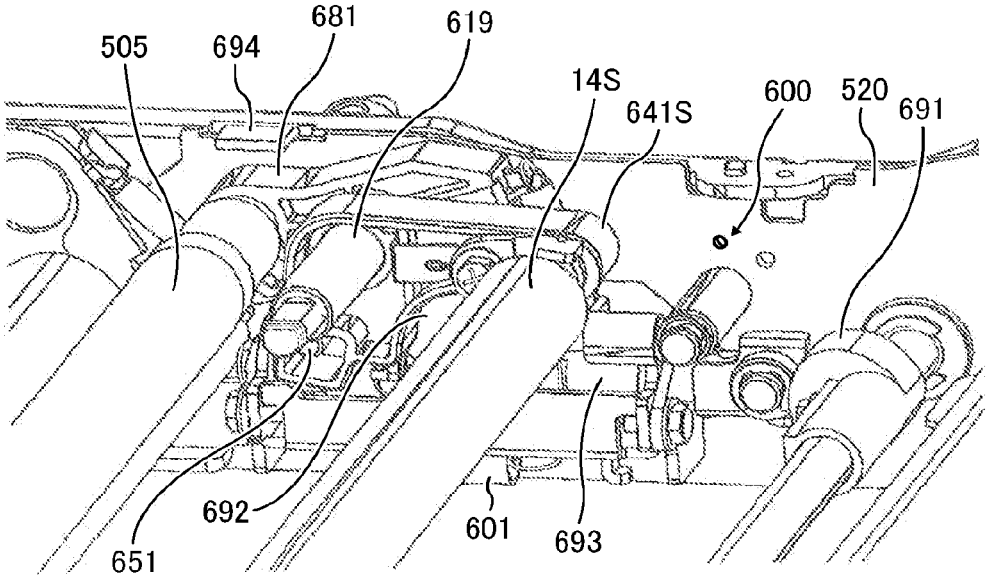
FIG. 13 is a perspective view schematically illustrating the contact-and-separation device for the roller and the primary transfer device facing the arbitrary image bearer corresponding to the special color in a separated state as viewed diagonally from above.
Figure 14:
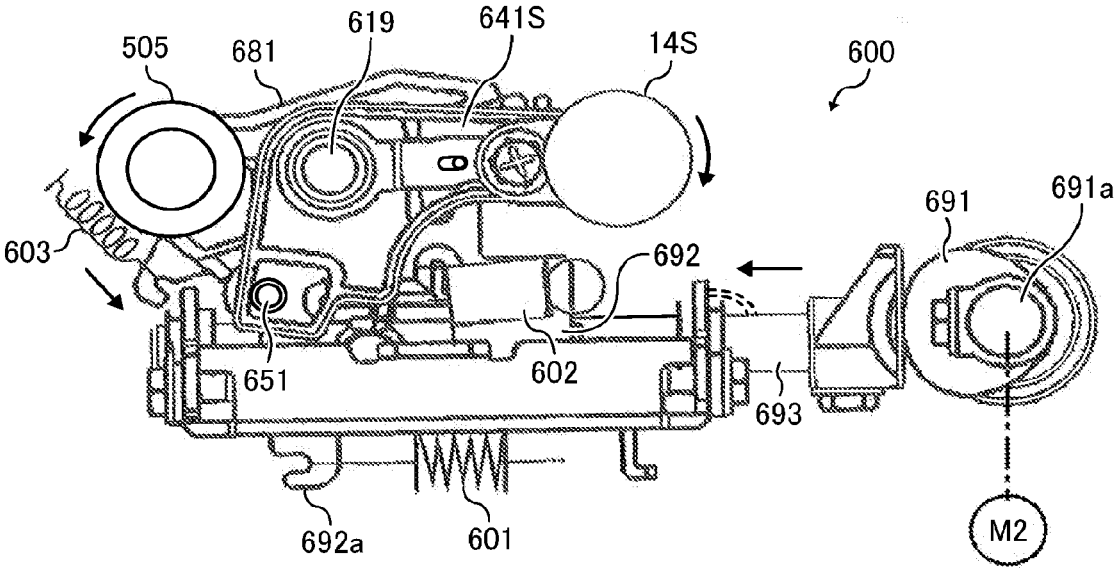
FIG. 14 is a side view schematically illustrating the contact-and-separation device for the roller and the primary transfer device facing the arbitrary image bearer corresponding to the special color in the separated state as viewed from the proximal side of the image forming apparatus.
Figure 15:
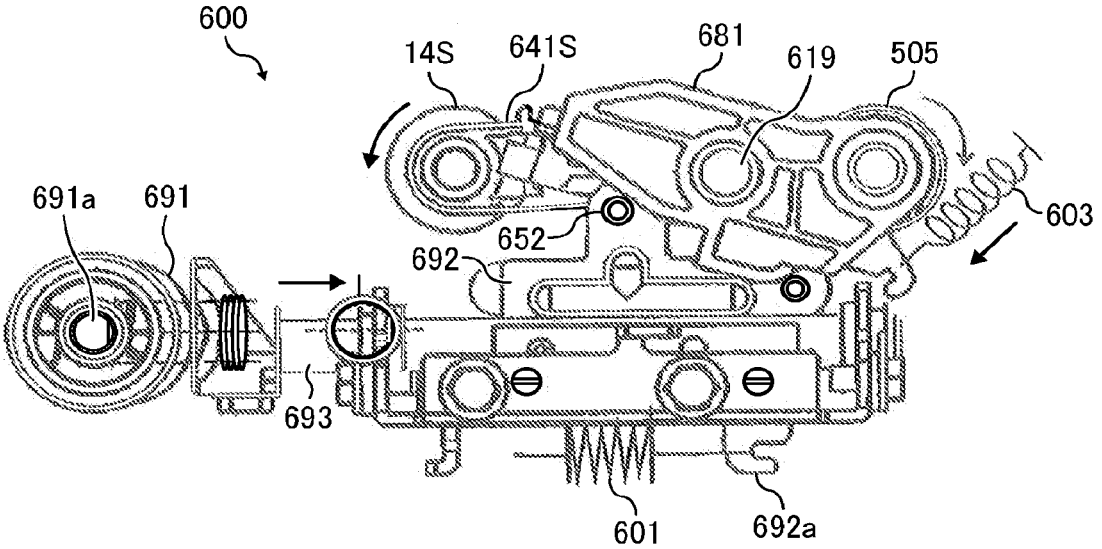
FIG. 15 is a side view schematically illustrating the contact-and-separation device for the roller and the primary transfer device facing the arbitrary image bearer corresponding to the special color in the separated state as viewed from the distal side of the image forming apparatus.
Figure 16:
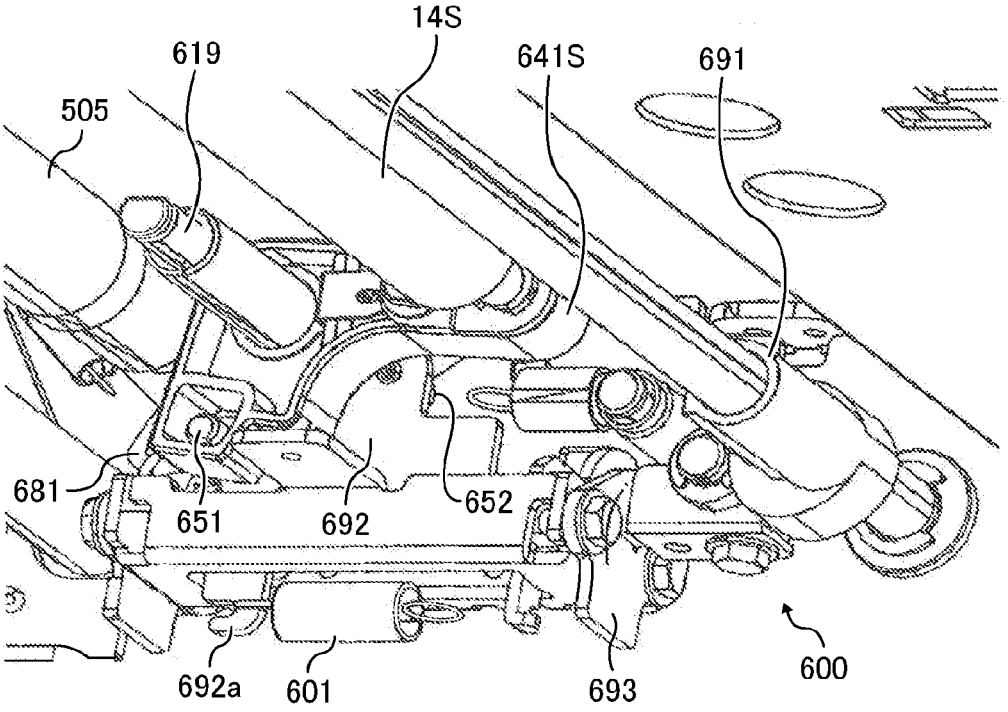
FIG. 16 is a perspective view schematically illustrating the contact-and-separation device for the roller and the primary transfer device facing the arbitrary image bearer corresponding to the special color in the separated state as viewed diagonally from below.

FIG. 13 is a perspective view schematically illustrating the contact-and-separation device 600 in the separated state, as viewed diagonally from above. FIG. 14 is a side view schematically illustrating the contact-and-separation device 600 in the separated state as viewed from the front side or the proximal side of the image forming apparatus. FIG. 15 is a side view schematically illustrating the contact-and-separation device 600 in the separated state as viewed from the back or the distal side of the image forming apparatus. FIG. 16 is a perspective view schematically illustrating the contact-and-separation device 600 in the separated state, as viewed diagonally from below. Although the transfer belt 510 and the photoconductor 40S are not illustrated in FIGS. 13 through 16, the transfer belt 510 is separated from the photoconductor 40S (in the separated state).

With reference to FIGS. 9 through 16, a description is provided of the contact-and-separation device 600 for the primary transfer roller 14S and the roller 505.

First, a description is provided of separation operation in which the photoconductor 40S and the transfer belt 510 in contact with each other such as illustrated in FIGS. 9 and 12 separate from each other as illustrated in FIGS. 13 and 16. In other words, the contact-and-separation device 600 in the contact state as illustrated in FIGS. 9 and 12 changes to the separated state as illustrated in FIGS. 13 and 16.

When separating the transfer belt 510 from the photoconductor 40S, a cam 691 is rotated via a rotational shaft 691*a* by a drive motor M2 serving as a drive source illustrated in FIGS. 10 and 14, thereby moving a slidable shaft 693 to the opposite side of the cam 691 such as illustrated in FIG. 14. A slidable member 692 that moves in the same direction as that of the slidable shaft 693 is attached to the slidable shaft 693. The slidable member 692 moves together with the slidable shaft 693. Two studs 651 (shown in FIG. 10) and 652 (shown in FIG. 11) are swaged onto the slidable member 692. The drive motor M2 is disposed on one of the lateral plates (for example, the lateral plate 521). The controller 540 controls rotation timing and the rotation direction of the drive motor M2.

As the slidable member 692 moves to an opposite side to the cam 691, the stud 651 disposed on the slidable member 692 comes in contact with a transfer-roller bracket 641S serving as a swingable support as illustrated in FIG. 14, and the stud 652 comes in contact with a roller bracket 681 as illustrated in FIG. 15.

The slidable member 692 keeps moving towards the opposite side to the cam 691 even after the studs 651 and 652 contact the transfer-roller bracket 641S and the roller bracket 681. Accordingly, the transfer-roller bracket 641S and the roller bracket 681 swingably move about a common shaft 619 in a direction opposite to a direction in which the transfer-roller bracket 641S and the roller bracket 681 project beyond the belt surface. In other words, the transfer-roller bracket 641S and the roller bracket 681 swingably move away from the photoconductor 40S. As a result, the primary transfer roller 14S and the roller 505 move downward, and the primary transfer roller 14S (the belt surface 510*a* of the transfer belt 510) separates from the photoconductor 40S.

Next, a description is provided of contact operation in which the transfer belt 510 separated from the photoconductor 40S such as illustrated in FIGS. 13 and 16 comes in contact with the photoconductor 40S such as illustrated in FIGS. 9 and 12. In other words, the contact-and-separation device 600 in the separated state as illustrated in FIGS. 13 and 16 changes to the contact state illustrated in FIGS. 9 and 12.

A tension of a spring 601 that pulls the slidable shaft 693 towards the cam 691 always acts on the slidable shaft 693. The spring 601 is attached to a hook 692*a* disposed on the bottom end of the slidable member 692.

When bringing the transfer belt 510 to the photoconductor 40S, the cam 691 is rotated via the rotational shaft 691*a* by the drive motor M2 and the tension of the spring 601 causes the slidable shaft 693 to move towards the cam 691 such as illustrated in FIG. 10. Accordingly, the slidable shaft 693 comes in contact with the cam 691.

As the slidable shaft 693 moves, hence causing the slidable member 692 to move towards the cam 691, the stud 651 disposed on the slidable member 692 separates from the transfer-roller bracket 641S as illustrated in FIG. 10. As illustrated in FIG. 11, the stud 652 disposed on the slidable member 692 separates from the roller bracket 681.

Forces of the springs 602 and 603 towards the photoconductor 40S always act on the transfer-roller bracket 641S and the roller bracket 681. Consequently, as the studs 651 and 652 separate from the transfer-roller bracket 641S and the roller bracket 681, the transfer-roller bracket 641S and the roller bracket 681 move swingably about the common shaft 619 as a fulcrum in the direction in which the transfer-roller bracket 641S and the roller bracket 681 project beyond the belt surface from the belt back surface. In other words, the transfer-roller bracket 641S and the roller bracket 681 swingably move towards the photoconductor 40S.

With this configuration, the primary transfer roller 14S and the roller 505 held by the transfer-roller bracket 641S and the roller bracket 681, respectively, move up. Subsequently, the roller bracket 681 contacts a lower surface of a bent portion 694, thereby positioning the roller 505 in place. The bent portion 694 is a part of the frame (i.e., the lateral plate 520 constituting the base of the transfer unit 500) which is bent projectingly towards inside the transfer unit 500. The primary transfer roller 14S contacts the photoconductor 40S via the transfer belt 510 and is positioned in place.

With this configuration, the primary transfer roller 14S and the roller 505 are positioned in place reliably, thereby tracking properly the transfer belt 510 looped around and stretched between the primary transfer roller 14S and the roller 505.

In the special color mode and in the combination mode, the controller 540 controls the drive motor M2 to move the contact-and-separation device 600 such that the primary transfer roller 14S contacts the photoconductor 40S via the transfer belt 510. In the full color mode and the black mode, the controller 540 controls the drive motor M2 to move the contact-and-separation device 600 such that the primary transfer roller 14S separates from the photoconductor 40S.

Figure 17:
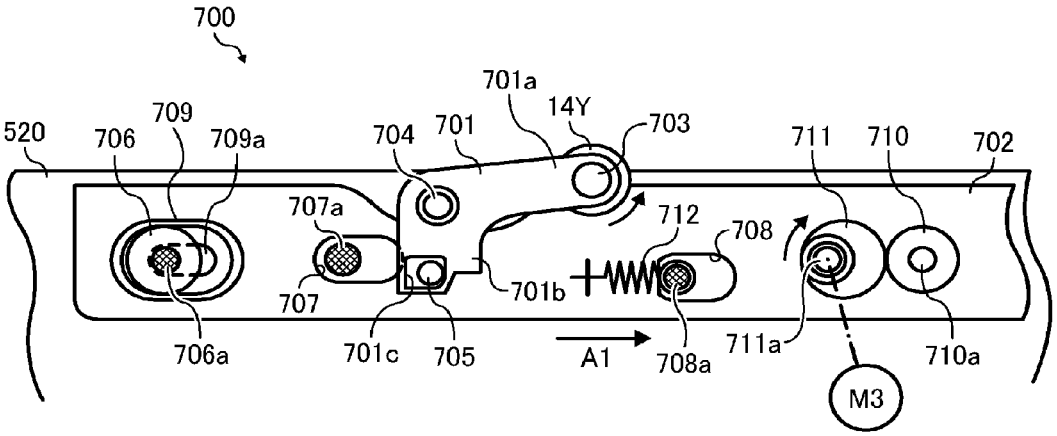
FIG. 17 is a side view schematically illustrating the contact-and-separation device for the primary transfer device facing an image bearer for the color yellow in the contact state as viewed from the proximal side of the image forming apparatus.
Figure 18:
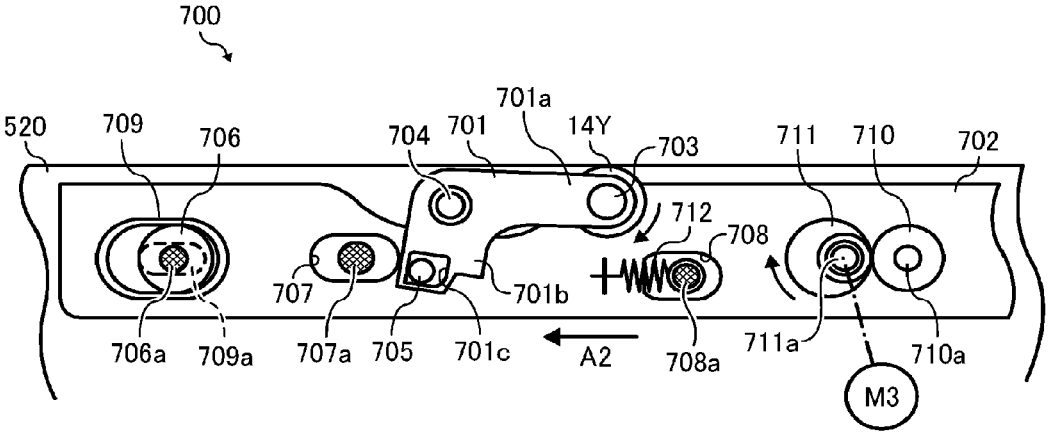
FIG. 18 is a side view schematically illustrating the contact-and-separation device for the primary transfer device facing the image bearer for the color yellow in the separated state as viewed from the proximal side of the image forming apparatus.

With reference to FIGS. 17 and 18, a description is provided of a contact-and-separation device 700, which is a common contact-and-separation device to the primary transfer rollers 14Y, 14M, and 14C corresponding to the colors yellow, magenta, and cyan, respectively. The primary transfer rollers 14Y, 14M, and 14C are moved by the common contact-and-separation device 700. With reference to FIGS. 17 and 18, a description is provided of contact and separation of the primary transfer roller 14Y for yellow.

As illustrated in FIGS. 17 and 18, the contact-and-separation device 700 includes a transfer-roller bracket 701, a slidable member 702, a cam 711 and a coil spring 712. The transfer-roller bracket 701 serves as a swingable support that movably supports the primary transfer roller 14Y. The slidable member 702 is slidably movable in contact and separation directions. The cam 711 moves the slidable member 702 in the contact and the separation directions. The coil spring 712 serves as a biasing member. A set of these devices are disposed facing another set of these devices in the direction perpendicular to a sheet plane, thereby constituting a pair of sets facing each other. This direction is orthogonal to the contact and the separation directions. Thus, a description is provided only of one of the sets of devices disposed on one of the lateral plates 520 and 521 of the transfer unit 500, that is, the lateral plate 520, in the direction perpendicular to the sheet plane.

The slidable member 702 is movably supported by the lateral plate 521 of the transfer unit 500 such that the slidable member 702 is movable in a direction A1 towards the right (i.e., contact direction) and in a direction A2 towards the left (separation direction) in FIGS. 17 and 18. More specifically, the slidable member 702 includes slots 707 and 708, and a guide 709 which extend horizontally, i.e., in the directions A1 and A2. The guide 709 includes a guide slot 709*a* that extends horizontally, i.e., in the directions A1 and A2 in FIGS. 17 and 18. A shaft 706*a* disposed on the lateral plate 520 is inserted to the guide slot 709*a* in the direction perpendicular to the sheet plane (the proximal side of the main body). A roller 706 is disposed on the shaft 706*a*. The roller 706 is disposed in the guide 709.

Guide pins 707*a* and 708*a* disposed on the lateral plate 520 are inserted to the slots 707 and 708, respectively, in the direction perpendicular to the sheet plane (the proximal side of the main body). With this configuration, the slidable member 702 is movably supported by the lateral plate 520 such that the slidable member 702 is movable in the direction A1 towards the right (i.e., contact direction) and in the direction A2 towards the left (separation direction) in FIGS. 17 and 18. It is to be noted that in FIGS. 17 and 18 the direction A1 to the right coincides with the contact direction and the direction A2 to the left coincides with the separation direction.

The coil spring 712 is a tension spring, with one end thereof hooked on the slidable member 702 and the other end hooked on the guide pin 708*a*. As the slidable member 702 moves to the right in the direction A1 (contact direction) such as illustrated in FIG. 17, the coil spring 712 is stretched. As the slidable member 702 moves to the left in the direction A2 (separation direction) such as illustrated in FIG. 18, the coil spring 712 is compressed.

The transfer-roller bracket 701 has a substantially L-like shape, and the curved portion is rotatably supported by a support shaft 704 disposed on the lateral plate 520. The primary transfer roller 14Y is rotatably supported by a shaft 703 at a first end 701*a* of the transfer-roller bracket 701. The other end, that is, a second end 701*b* opposite to the first end 701*a* via the support shaft 704 includes an opening 701*c* into which a stud 705 disposed on the slidable member 702 is inserted in the direction perpendicular to the sheet plane (the proximal side of the main body). As the slidable member 702 moves to the right in the direction A1 (contact direction) such as illustrated in FIG. 17, the stud 705 contacts the inner surface of the opening 701*c* of the second end 701*b*, thereby pushing the transfer-roller bracket 701 to the right. As the slidable member 702 moves to the left in the direction A2 (separation direction) such as illustrated in FIG. 18, the stud 705 contacts the inner surface of the opening 701*c* of the second end 701*b*, thereby pushing the transfer-roller bracket 701 to the left. As the slidable member 702 moves to the right in the direction A1

(contact direction) such as illustrated in FIG. 17, the primary transfer roller 14Y swingably moves in the direction (contact direction) in which the primary transfer roller 14Y projects towards the belt surface from the back surface of the transfer belt 510. By contrast, as the slidable member 702 moves to the left in the direction A2 (separation direction) such as illustrated in FIG. 18, the primary transfer roller 14Y moves in the separation direction opposite to the contact direction. In other words, the primary transfer roller 14Y is supported swingably in the direction moving away from the photoconductor 40Y, that is, in the separation direction. The cam 711 is an eccentric cam fixed on a drive shaft 711*a*. The drive shaft 711*a* is driven to rotate by a drive motor M3 serving as a drive source. The drive shaft 711*a* penetrates through the lateral plate 520 and the slidable member 702 in the direction perpendicular to the sheet plane (the proximal side of the main body). The cam 711 is disposed on the slidable member 702. A ball bearing 710 rotatably supported by a shaft 710*a* is disposed on the slidable member 702 such that the ball bearing 710 as a rotational support contacts the cam surface of the cam 711. The ball bearing 710 (pressingly) contacts the cam surface due to the coil spring 712. The drive motor M3 is disposed on the lateral plate 520. The controller 540 controls rotation timing and the rotation direction of the drive motor M3.

Similar to the primary transfer roller 14Y for yellow, the primary transfer rollers 14M and 14C corresponding to the colors magenta and cyan are movably supported by the slidable member 702 in the same manner as that of the primary transfer roller 14Y.

In the full color mode and in the combination mode, the controller 540 controls the drive motor M3 to carry out the contact operation. In the special color mode and the black mode, the controller 540 controls the drive motor M3 to carry out the separation operation.

Figure 19:
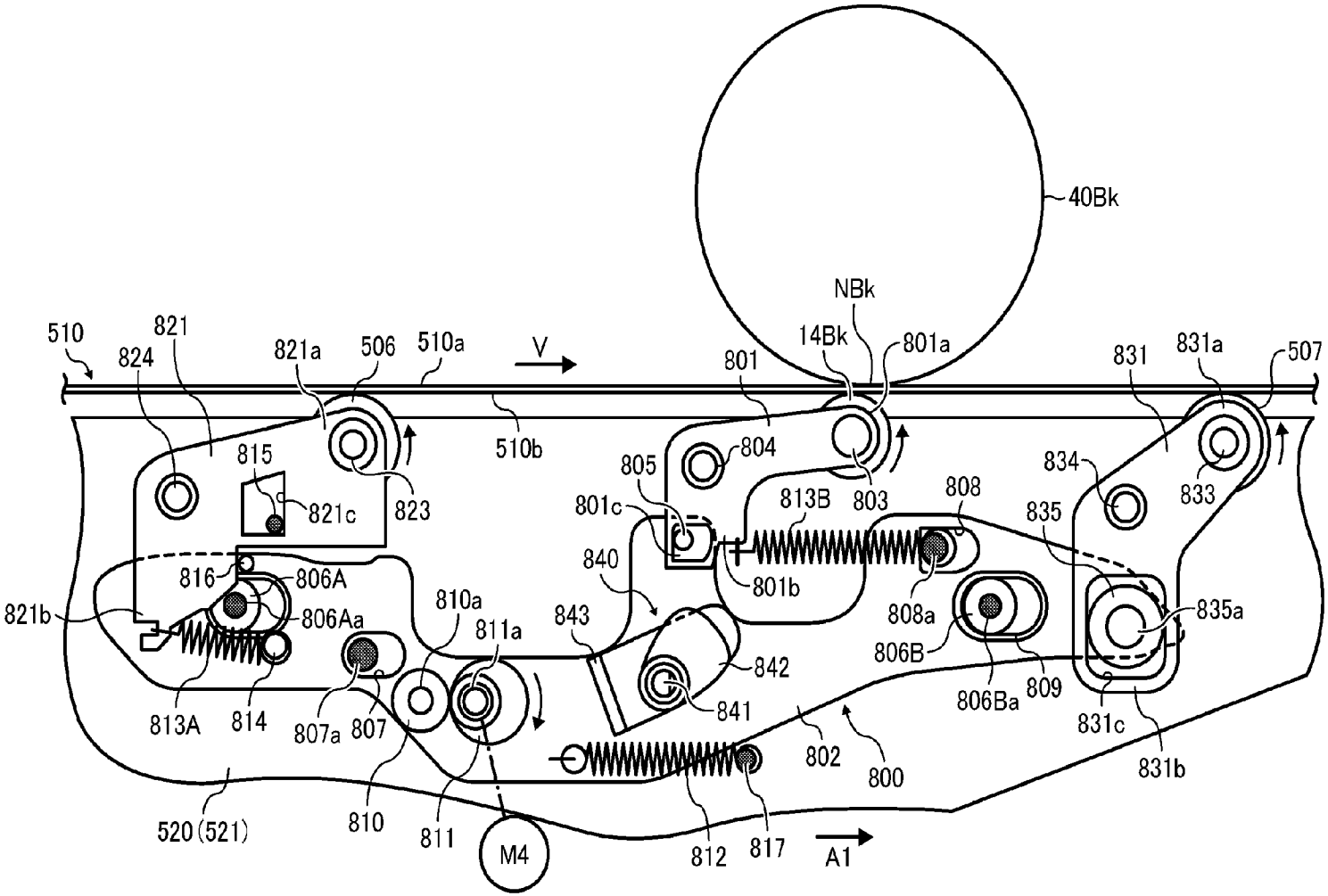
FIG. 19 is a side view schematically illustrating a contact-and-separation device for a plurality of rollers and the primary transfer device facing an image bearer for the color black in the contact state as viewed from the proximal side of the image forming apparatus.
Figure 20:
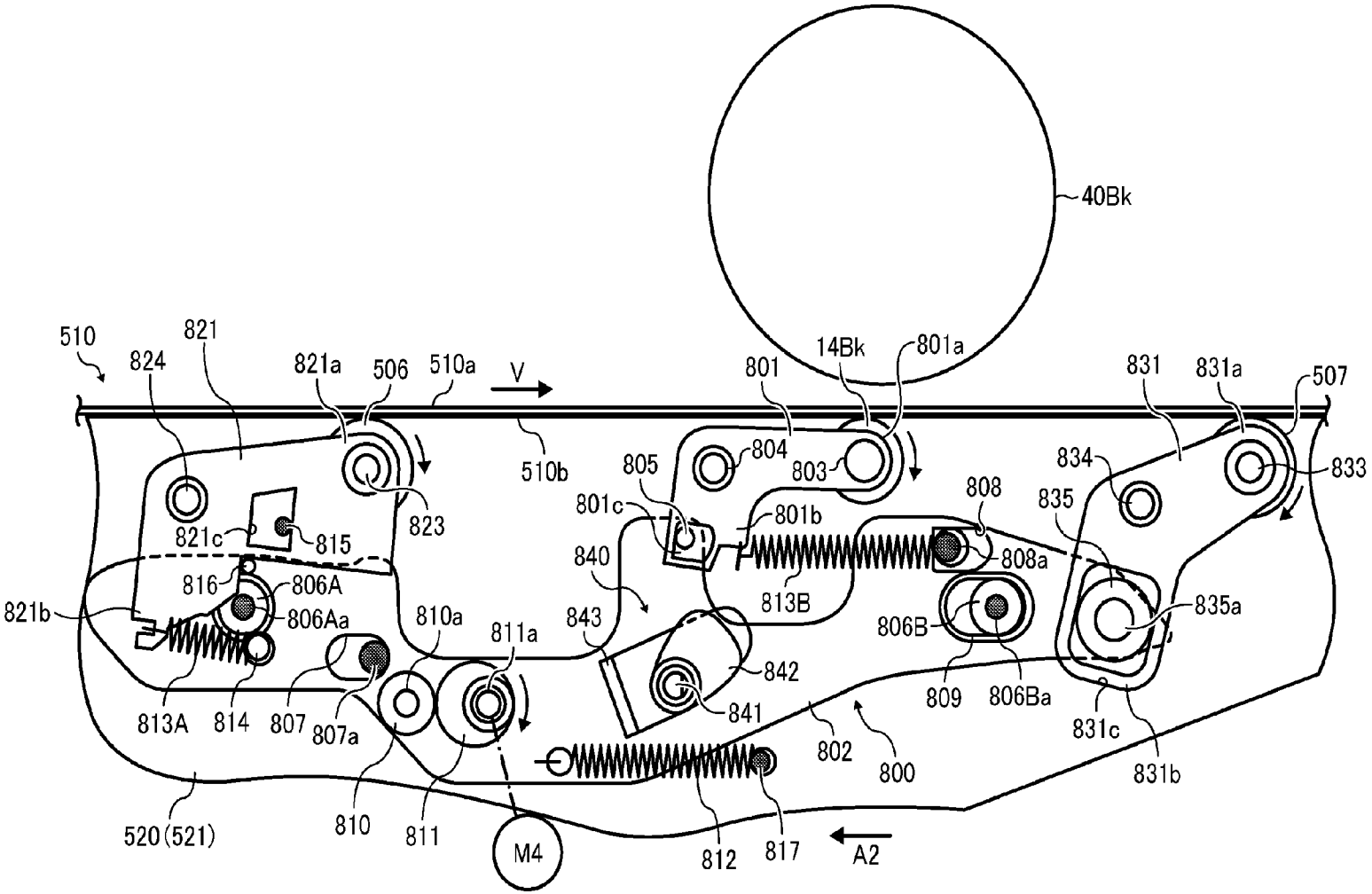
FIG. 20 is a side view schematically illustrating the contact-and-separation device for the plurality of rollers and the primary transfer device facing the image bearer for the color black in the separated state as viewed from the proximal side of the image forming apparatus.

Next, with reference to FIGS. 19 and 20, a description is provided of a contact-and-separation device 800 for the primary transfer roller 14Bk corresponding to the color black, and the rollers 506 and 507. The roller 506 constitutes an upstream roller disposed upstream from the primary transfer roller 14Bk in the traveling direction V of the transfer belt 510. The roller 507 constitutes a downstream roller disposed downstream from the primary transfer roller 14Bk in the traveling direction V of the transfer belt 510. In other words, the roller 506 is disposed upstream from the transfer portion NBk for black while the roller 507 is disposed downstream from the transfer portion NBk.

The primary transfer roller 14Bk is movably supported by a transfer-roller bracket 801 serving as a swingable support, thereby enabling the primary transfer roller 14Bk to contact and separate from the belt back surface 510*b* of the transfer belt 510. The roller 506 is movably supported by a roller bracket 821 serving as a swingable support, thereby enabling the roller 506 to contact and separate from the belt back surface 510*b* of the transfer belt 510. The roller 507 is movably supported by a roller bracket 831 serving as a swingable support, thereby enabling the roller 507 to contact and separate from the belt back surface 510*b* of the transfer belt 510.

As illustrated in FIGS. 19 and 20, the contact-and-separation device 800 includes a slidable member 802, a cam 811, and a coil spring 812. The slidable member 802 enables the transfer-roller bracket 801, and the roller brackets 821 and 831 to move in the contact and the separation directions. The cam 811 moves the slidable member 802 in the contact and the separation directions. The coil spring 812 serves as a biasing member. A set of these devices are disposed facing another set of these devices in the direction perpendicular to the sheet plane. This direction is orthogonal to the contact and the separation directions. Thus, a description is provided only of one of the sets of devices disposed on one of the lateral plates 520 and 521 of the transfer unit 500 in the direction perpendicular to the sheet plane, that is, the lateral plate 520.

The slidable member 802 is movably supported by the lateral plate 520 of the transfer unit 500 such that the slidable member 802 is movable in the direction A1 towards the right (i.e., contact direction) and in the direction A2 towards the left (separation direction) in FIGS. 19 and 20. More specifically, the slidable member 802 includes slots 807 and 808, and guides 809, which extend horizontally, i.e., in the left-right direction in FIGS. 19 and 20. Guide pins 807*a* and 808*a* disposed on the lateral plate 520 are inserted to the slots 807 and 808, respectively, in the direction perpendicular to the sheet plane (the proximal side of the main body). Shafts 806Aa and 806Ba disposed on the lateral plate 520 are inserted to the guide 809 in the direction perpendicular to the sheet plane (the proximal side of the main body). Rollers 806A and 806B are disposed on the shafts 806Aa and 806Ba, respectively. The rollers 806A and 806B are disposed in the guides 809. With this configuration, the slidable member 802 is movably supported by the lateral plate 520 such that the slidable member 802 is movable in the direction A1 towards the right (i.e., contact direction) and in the direction A2 towards the left (separation direction) in FIGS. 19 and 20. It is to be noted that in FIGS. 19 and 20 the direction A1 to the right coincides with the contact direction, and the direction A2 to the left coincides with the separation direction.

The coil spring 812 is a tension spring, with one end thereof hooked on the slidable member 802 and the other end hooked on the guide pin 817. As the slidable member 802 moves to the right in the direction A1 (contact direction) such as illustrated in FIG. 19, the coil spring 812 is stretched. As the slidable member 802 moves to the left in the direction A2 (separation direction) such as illustrated in FIG. 20, the coil spring 812 is compressed.

The transfer-roller bracket 801 has a substantially L-like shape, and the curved portion of the transfer-roller bracket 801 is rotatably supported by a support shaft 804 disposed on the lateral plate 520. The primary transfer roller 14Bk is rotatably supported by a shaft 803 at a first end 801*a* of the transfer-roller bracket 801. The other end, that is, a second end 801*b* opposite to the first end 801*a* via a support shaft 804 includes an opening 801*c* into which a stud 805 disposed on the slidable member 802 is inserted in the direction perpendicular to the sheet plane (the proximal side of the main body).

As the slidable member 802 moves to the right in the direction A1 (contact direction) such as illustrated in FIG. 19, the stud 805 contacts the inner surface of the opening 801*c* of the second end 801*b*, thereby pushing the transfer-roller bracket 801 to the right. As the slidable member 802 moves to the left in the direction A2 (separation direction) such as illustrated in FIG. 20, the stud 805 contacts the inner surface of the opening 801*c* of the second end 801*b*, thereby pushing the transfer-roller bracket 801 to the left. As the slidable member 802 moves to the right in the direction A1 (contact direction) such as illustrated in FIG. 19, the primary transfer roller 14Bk swingably moves in the direction (contact direction) in which the primary transfer roller 14Bk projects towards the belt surface 510*a* from the opposing surface (the belt back surface 510*b* 510*b*) of the transfer belt 510. By contrast, as the slidable member 802 moves to the left in the direction A2 (separation direction) such as illustrated in FIG. 20, the primary transfer roller 14Bk moves in the separation direction opposite to the contact direction. In other words, the primary transfer roller 14Bk is supported swingably in the direction moving away from the photoconductor 40Bk, that is, in the separation direction.

One end of a coil spring 813B is hooked on a guide pin 808*a* and the other end of the coil spring 813B is hooked on the second end 801*b* of the transfer-roller bracket 801. The coil spring 813B is a tension spring and serves as a biasing member to bias the transfer-roller bracket 801 in the contact direction.

The roller bracket 821 has a substantially L-like shape, and the curved portion of the roller bracket 821 is rotatably supported by a support shaft 824 disposed on the lateral plate 520. The roller 506 is rotatably supported by a shaft 823 at a roller-bracket first end 821*a* of the roller bracket 821, and serves as a driven roller. One end of a coil spring 813A is hooked on a guide pin 814 disposed on the slidable member 802, and the other end of the coil spring 813A is hooked on a roller-bracket second end 821*b* of the roller bracket 821. The roller-bracket second end 821*b* of the roller bracket 821 is opposite to the roller-bracket first end 821*a* via the support shaft 824. The coil spring 813A is a tension spring and serves as a biasing member to bias the roller bracket 821 in the contact direction.

The roller bracket 821 includes an opening 821*c* formed between the roller-bracket first end 821*a* of the roller bracket 821 and the support shaft 824. A stud 815 disposed on the lateral plate 520 is inserted to the opening 821*c* in the direction perpendicular to the sheet plane (the proximal side of the main body). The opening 821*c* and the stud 815 constitute a stopper to adjust an elevated position of the roller bracket 821 (roller 506) in the contact direction. A pin 816 is projectingly disposed on the slidable member 802 in the direction perpendicular to the sheet plane (proximal side of the main body). As the slidable member 802 moves to the left (in the separation direction indicated by arrow A2), the pin 816 contacts the roller bracket 821, thereby pushing the roller bracket 821 in the direction A2, that is, in the separation direction. The pin 816 serves as a separation member.

As the slidable member 802 moves to the right in the direction A1 (contact direction) such as illustrated in FIG. 19, the roller bracket 821 is pulled by the coil spring 813A and rotates about the support shaft 824. Consequently, the stud 815 contacts the opening 821*c*, thereby stopping the roller bracket 821. As the slidable member 802 moves to the left in the direction A2 (separation direction) such as illustrated in FIG. 20, the pin 816 contacts the roller-bracket second end 821*b*, thereby pushing the roller bracket 821 to the left. As the slidable member 802 moves to the right in the direction A1 (contact direction) such as illustrated in FIG. 19, the roller 506 swingably moves in the direction (contact direction) in which the roller 506 projects towards the belt surface 510*a* from the opposing surface (the belt back surface 510*b* 510*b*) of the transfer belt 510. By contrast, as the slidable member 802 moves to the left in the direction A2 (separation direction) such as illustrated in FIG. 20, the roller 506 moves in the separation direction opposite to the contact direction. In other words, the roller 506 is supported swingably in the direction moving away from the photoconductor 40Bk, that is, in the separation direction.

The roller bracket 831 has a substantially L-like shape, and the curved portion of the roller bracket 831 is rotatably supported by a support shaft 834 disposed on the lateral plate 520. The roller 507 is rotatably supported by a shaft 833 at a roller-bracket first end 831*a* of the roller bracket 831, and serves as a driven roller. The roller bracket 831 includes an opening 831*c* formed at a roller-bracket second end 831*b* opposite to the roller-bracket first end 831*a* via the support shaft 834. A ball bearing 835 rotatably supported on the slidable member 802 by a shaft 835*a* is inserted to the opening 831*c* in the direction perpendicular to the sheet plane (from the distal side of the main body).

As the slidable member 802 moves to the right in the direction A1 (contact direction) such as illustrated in FIG. 19, the ball bearing 835 presses the inner surface of the opening 831*c* of the roller-bracket second end 831*b* to the left. As the slidable member 802 moves to the left in the direction A2 (separation direction) such as illustrated in FIG. 20, the ball bearing 835 presses the inner surface of the opening 831*c* to the left. As the slidable member 802 moves to the right in the direction A1 (contact direction) such as illustrated in FIG. 19, the roller 507 swingably moves in the direction (contact direction) in which the roller 507 projects towards the belt surface 510*a* from the opposing surface (the belt back surface 510*b* 510*b*) of the transfer belt 510. By contrast, as the slidable member 802 moves to the left in the direction A2 (separation direction) such as illustrated in FIG. 20, the roller 507 moves in the separation direction opposite to the contact direction. In other words, the roller 507 is supported swingably in the direction moving away from the photoconductor 40Bk, that is, in the separation direction.

The cam 811 is an eccentric cam fixed on a drive shaft 811*a*. The drive shaft 811*a* is driven to rotate by a drive motor M4 serving as a drive source. The drive shaft 811*a* penetrates through the lateral plate 520 and the slidable member 802 in the direction perpendicular to the sheet plane (the proximal side of the main body). The cam 811 is disposed on the slidable member 802. A ball bearing 810 rotatably supported on the slidable member 802 by a shaft 810*a* is disposed such that the ball bearing 810 as a rotational support contacts the cam surface of the cam 811. The ball bearing 810 (pressingly) contacts the cam surface due to the coil spring 812. The drive motor M4 is disposed on the lateral plate 520. The controller 540 controls rotation timing and the rotation direction of the drive motor M4.

In the full color mode and in the combination mode, the controller 540 controls the drive motor M4 to carry out the contact operation. In the special color mode and the black mode, the controller 540 controls the drive motor M4 to carry out the separation operation.

The transfer unit 500 includes a manual operation device 840 to move manually the slidable member 802 in the left and the right directions (i.e., the contact and the separation directions). The manual operation device 840 includes a shaft 841, a cam 842 disposed on the shaft 841, a receiver 843 disposed on the slidable member 802, and a manual lever 844 (illustrated in FIG. 25) as a stopper. The shaft 841 extends in the direction perpendicular to the sheet plane (the proximal side of the main body), and is rotatably supported by the lateral plate 520. The shaft 841 is rotatable and is inserted to the slidable member 802. The cam 842 is fixed to the shaft 841 and is disposed on the slidable member 802. The manual lever 844 is fixed to an end portion of the shaft 841 in the direction perpendicular to the sheet plane (the proximal side of the main body). The manual lever 844 is disposed on the front side relative to the lateral plate 521 at the front side of the main body. The lateral plate 521 is disposed facing the lateral plate 520 and on the front side of the lateral plate 520. The manual lever 844 is rotatably supported on the lateral plate 521 by the shaft 841, and a portion of the manual lever 844 is connected to the cam 842 constituting the contact-and-separation device 800.

Figure 21:
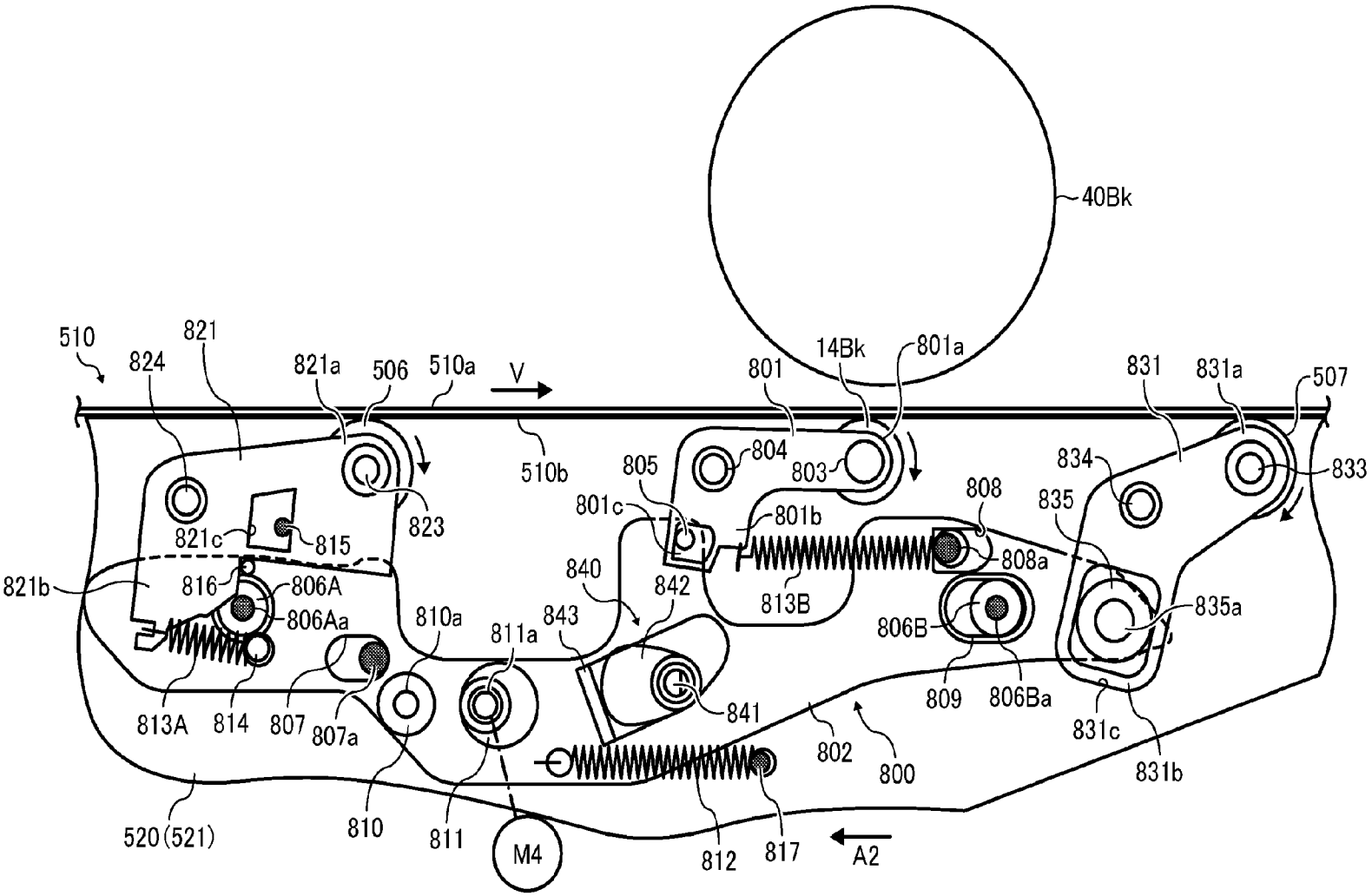
FIG. 21 is a side view schematically illustrating the contact-and-separation device for the plurality of rollers and the primary transfer device facing the image bearer for the color black in the separated state as viewed from the proximal side of the image forming apparatus.
Figure 25:
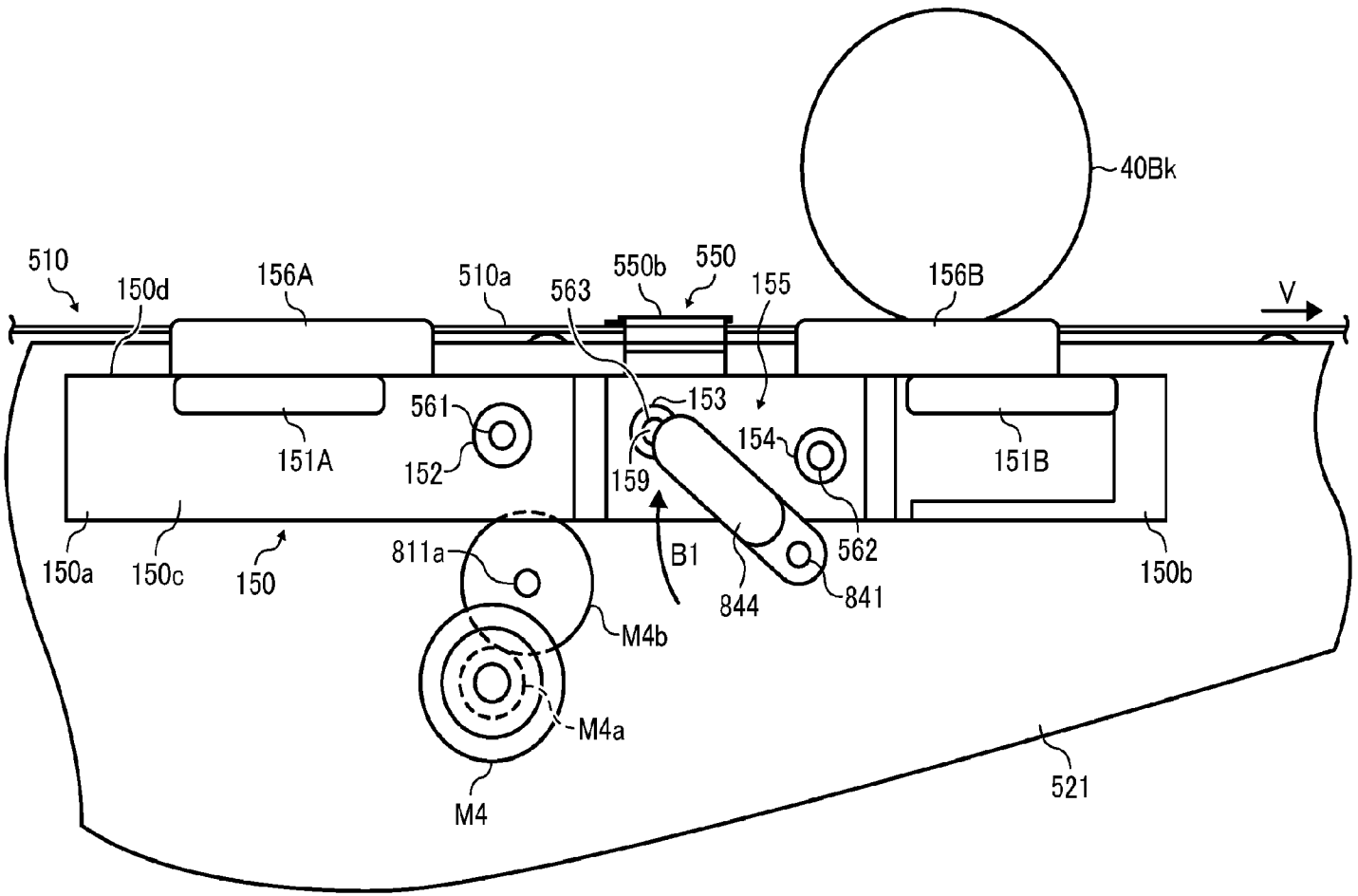
FIG. 25 is a side view schematically illustrating a cover mounted on a base and a stopper in a regulating state as viewed from the proximal side of the image forming apparatus.

The cam 842 is an eccentric cam. As illustrated in FIG. 21, as the manual lever 844 rotates in the separation direction such as shown in FIG. 25, the cam 842 rotates and comes in contact with the receiver 843, thereby moving the slidable member 802 in the separation direction in the direction A2 irrespective of the position of the cam 811. As the manual lever 844 is rotated in a direction of lock (see FIG. 26), the cam 842 rotates and separates from the receiver 843 such as shown in FIG. 19. Accordingly, the force of the coil spring 812 in the contact direction in the direction A1 moves the slidable member 802.

According to the present illustrative embodiment, the contact-and-separation device 600 that moves the primary transfer roller 14S, the contact-and-separation device 700 that moves the primary transfer rollers 14Y, 14M, and 14C, and the contact-and-separation device 800 that moves the primary transfer roller 14Bk are disposed separately. This configuration enables the first mode through the fourth mode, and the separation mode.

As illustrated in FIGS. 2 through 5, the scale unit 530 is supported by the lateral plate 521 at the proximal side of the main body such that the detection surface is situated at the belt back surface 510*b* side.

More specifically, the scale unit 530 is disposed downstream from the roller 506 in the traveling direction V of the transfer belt 510. The roller 506 serves as an arbitrary rotational support disposed upstream from the transfer portion NBk for black in the traveling direction V among the plurality of rotational supports. That is, the scale unit 530 is movably supported by the contact-and-separation device 800, thereby enabling the scale unit 530 to contact and separate from the belt back surface 510*b* of the transfer belt 510. With this configuration, even in the black mode, the scale marks M of the transfer belt 510 can be detected sequentially by the scale mark detectors 531A and 531B, and the feedback control is carried out using the scale marks M.

According to the present illustrative embodiment, the belt pressing member 550 and the scale unit 530 are separately movable in the special color mode, which is an arbitrary mode. More specifically, the belt pressing member 550 and an inner cover 150 constitute a single integrated body which is mounted on the lateral plate 521. The scale unit 530 is swingably supported by a bracket 533 which is rotatable relative to the lateral plate 521. The bracket 533 is a part of the contact-and-separation device 800. That is, the scale unit 530 is movably supported by the contact-and-separation device 800.

According to the present illustrative embodiment, the contact-and-separation device that moves the scale unit 530 is similar to or the same as the contact-and-separation device 800 that moves the primary transfer roller 14Bk, and the rollers 505 and 506. With this configuration, no contact-and-separation device dedicated to the scale unit 530 is necessary. The number of parts and the space can be reduced as compared with assigning the contact-and-separation device individually.

The belt pressing member 550 is disposed opposite to the scale unit 530 via the transfer belt 510. More specifically, the belt pressing member 550 is disposed above the belt surface 510*a* of the transfer belt 510.

While the scale unit 530 is in contact with the transfer belt 510, the transfer belt 510 and the photoconductor 40Bk rub against each other. Thus, when the transfer belt 510 is separated from the photoconductor 40Bk, it is necessary to separate the scale unit 530 from the transfer belt 510. In a case in which the scale unit 530 is separated from the transfer belt 510, if the scale unit 530 remains in contact with the belt pressing member 550 via the transfer belt 510, the belt track of the transfer belt 510 formed with the roller 506, the scale unit 530, and the roller 507 needs to be in a straight line in order to prevent deformation or bending of the transfer belt 510. However, depending on a layout it may be difficult to dispose the cam 811 immediately below the scale unit 530. In such a case, as the scale unit 530 is separated from the transfer belt 510, the transfer belt 510 may not be horizontal.

In order to prevent deformation of the transfer belt 510 while the scale unit 530 and the belt pressing member 550 are in contact, the track of the transfer belt 510 formed with the rollers 506 and 507, and the scale unit 530 needs to be slant, not horizontal. Consequently, the roller 507 has the greatest degree of separation from the transfer belt 510. However, in the special color mode, if the roller 507 is lowered too much, the tension at which the transfer belt 510 is taut decreases, loosening the transfer belt 510. As a result, the transfer belt 510 may come in contact with and rub against other parts.

Figure 22:
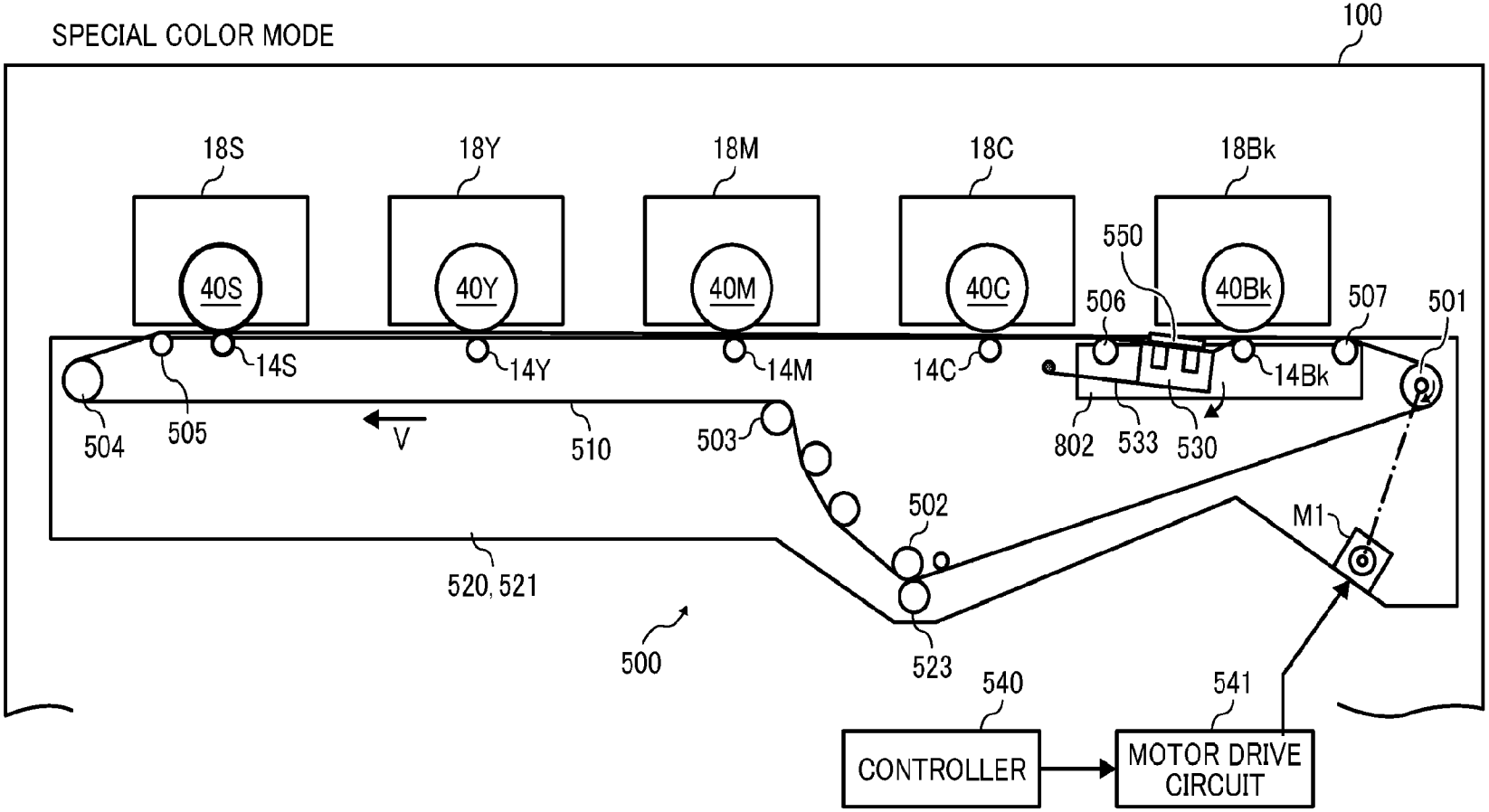
FIG. 22 is a conceptual diagram for explaining deformation of the belt in the special color mode using the special color.

As described above, the amount by which the roller 507 is lowered in the separation direction in which the transfer belt 510 separates is limited. Thus, it is difficult to tilt significantly the track of the transfer belt 510. In the event in which the amount by which the roller 507 is lowered cannot be increased, it is necessary to lower the track of the transfer belt 510 at the scale unit 530 and to raise the track at the roller 506 upstream from the scale unit 530 in the traveling direction V of the transfer belt 510. However, while the belt pressing member 550 keeps pressing, as illustrated in FIG. 22, bending or deformation of the transfer belt 510 such as shown in FIG. 22 occurs.

Figure 23:
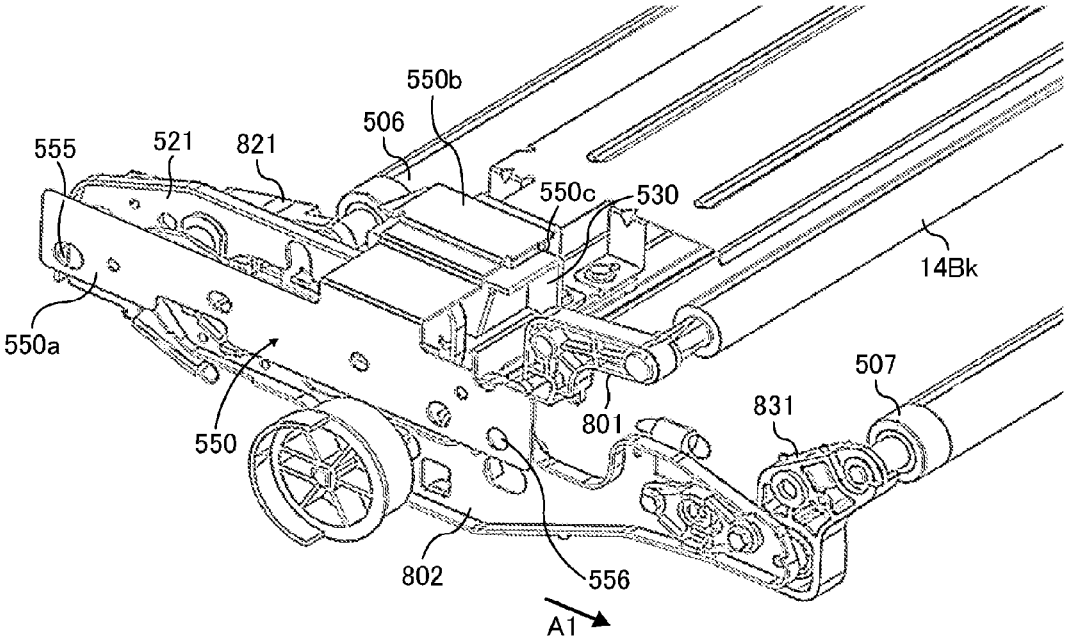
FIG. 23 is a perspective view schematically illustrating the contact-and-separation device for the plurality of rollers and the primary transfer device facing the image bearer for the color black in the contact state, and a belt pressing device as viewed from the proximal side of the image forming apparatus.
Figure 24:
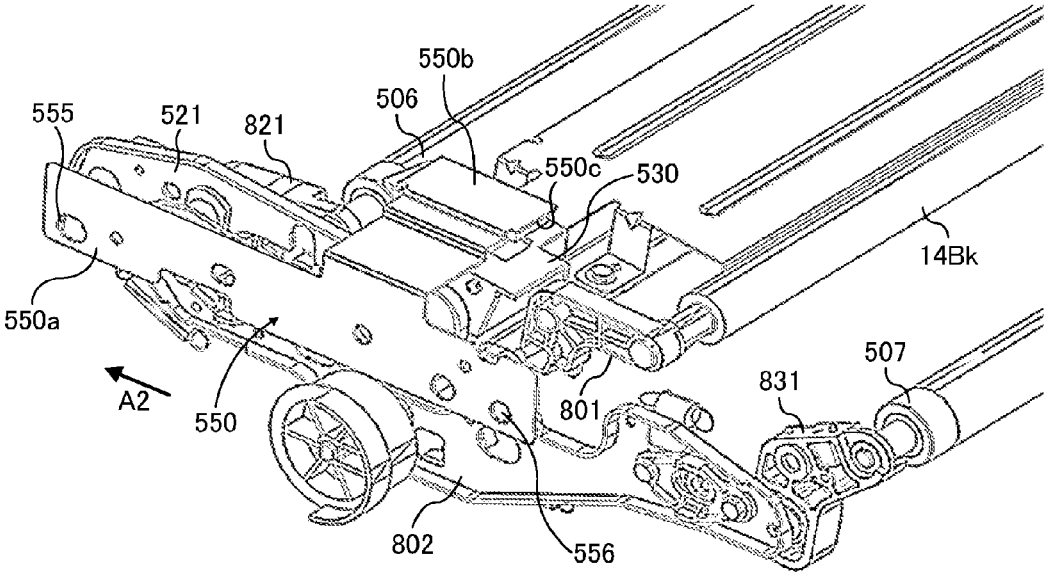
FIG. 24 is a perspective view schematically illustrating the contact-and-separation device for the plurality of rollers and the primary transfer device facing the image bearer for the color black in the separated state, and the belt pressing device as viewed from the proximal side of the image forming apparatus.

In view of the above, according to the present illustrative embodiment, the belt pressing member 550 is detachably mountable independent of the scale unit 530. More specifically, in the contact mode in which the transfer belt 510 is in contact with the photoconductor 40Bk by the contact-and-separation device 800 shown in FIGS. 19 and 20, as illustrated in FIGS. 23 and 24, the belt pressing member 550 is prevented from separating from the lateral plate 521. In the separation mode in which the transfer belt 510 is separated from the photoconductor 40Bk, the belt pressing member 550 is detachable from the lateral plate 521.

Figure 26:
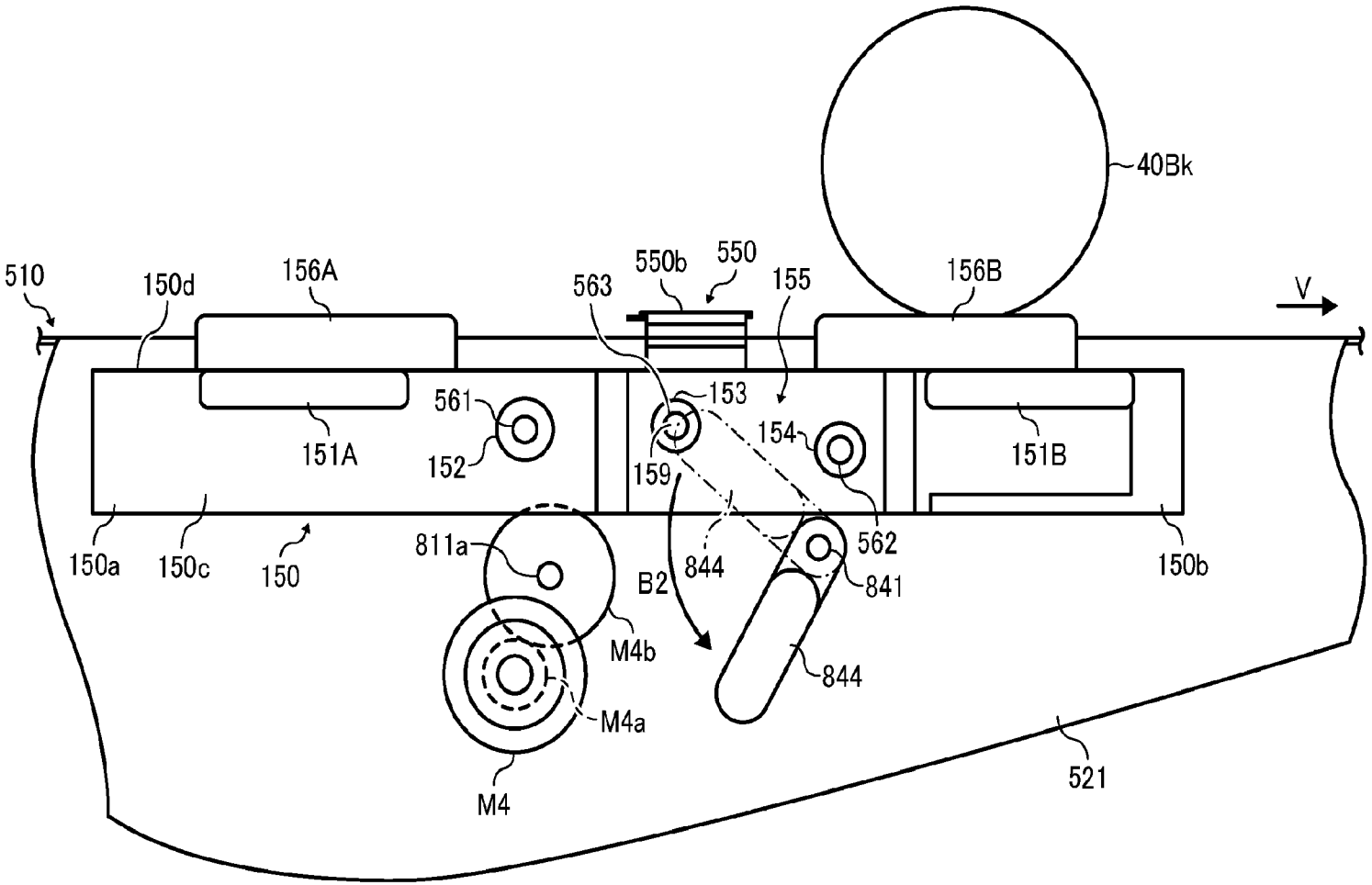
FIG. 26 is a side view schematically illustrating the cover mounted on the base and the stopper as viewed from the proximal side of the image forming apparatus when the stopper is released.

Next, with reference to FIGS. 25 and 26, a description is provided of installation and detachment of the belt pressing member 550.

As illustrated in FIGS. 25 and 26, the belt pressing member 550 and the inner cover 150 constitute a single integrated body. The inner cover 150 covers an exterior of the main body 100 and a portion of the transfer unit 500 which is mounted in the main body 100 from the proximal side of the main body 100. The inner cover 150 is detachably mountable relative to the lateral plate 521. In an installed state in which the inner cover 150 is mounted on the lateral plate 521, when the manual lever 844 fixed to a manual shaft 841 is rotated in a lock direction indicated by arrow B1, as illustrated in FIG. 25, the inner cover 150 is situated between the manual lever 844 and the lateral plate 521, thereby stopping detachment of the inner cover 150. In the installed state in which the inner cover 150 is mounted on the lateral plate 521, when the manual lever 844 fixed to the manual shaft 841 is rotated in a direction indicated by arrow B2, as illustrated in FIG. 26, the inner cover 150 is situated such that the inner cover 150 does not to overlap with the manual lever 844, thereby allowing detachment of the inner cover 150 from the lateral plate 521.

Figure 27:
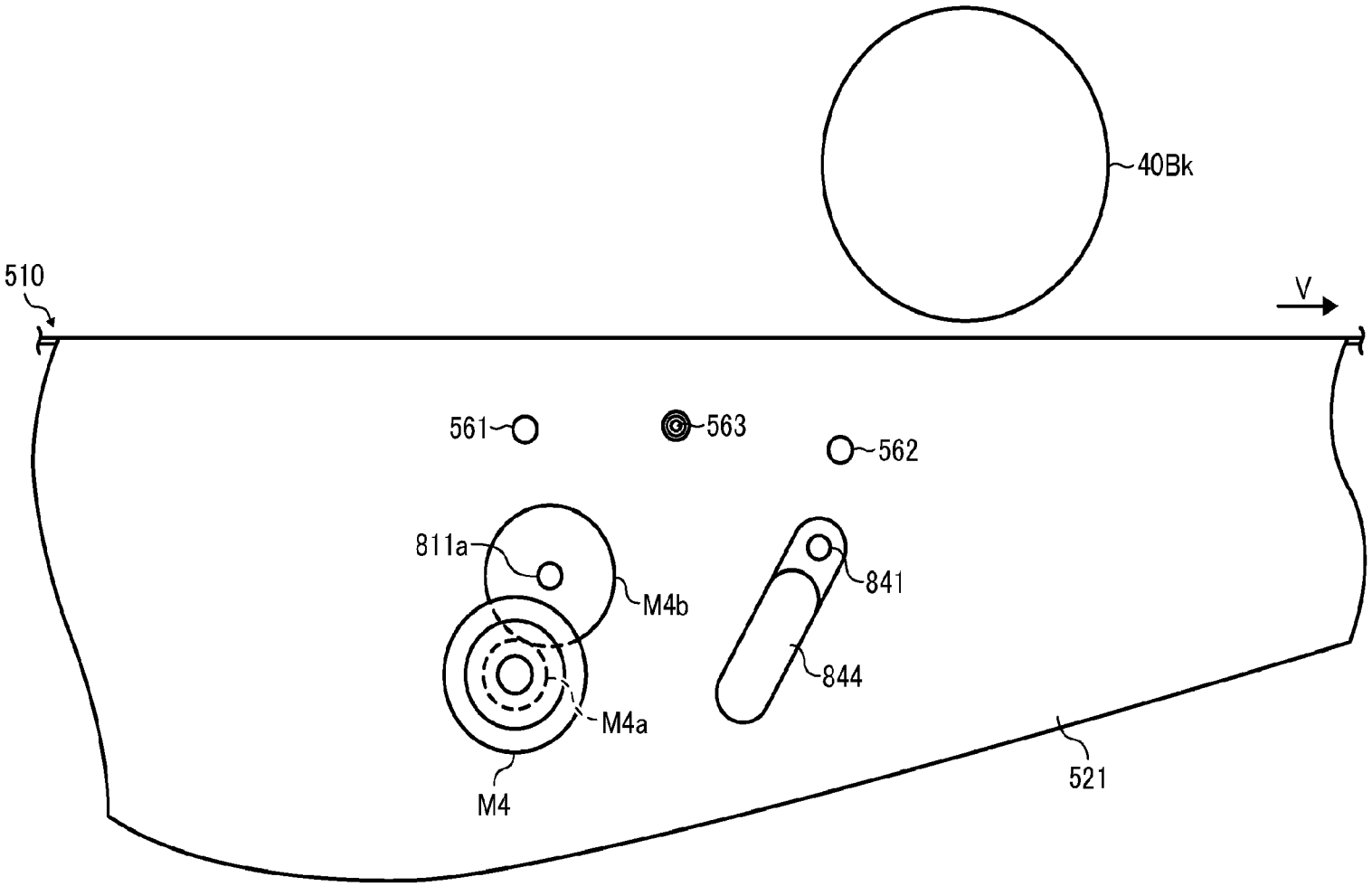
FIG. 27 is a side view schematically illustrating the base on which the cover is mounted and a configuration near the base.

As illustrated in FIG. 27, pins 561 and 562, and a screw hole 563 are arranged horizontally or in the left-right direction at predetermined intervals. The drive motor M4 is disposed substantially below the pins 561 and 562, and the screw hole 563 on the lateral plate 521. The rotational driving force of the drive motor M4 is transmitted to the drive shaft 811*a* shown in FIGS. 19 and 20 via a plurality of gears M4*a* and M4*b*. More specifically, the contact-and-separation device 800 includes the drive motor M4 and the plurality of gears M4*a* and M4*b*. The inner cover 150 covers a portion of at least one of the plurality of gears M4*a* and M4*b*. With this configuration, when the transfer unit 500 is detached from the main body 100, the inner cover 150 covers a portion of the gear M4*b* to reduce the likelihood of or prevent injury of technicians when contacting the gear M4 upon working.

Figure 28:
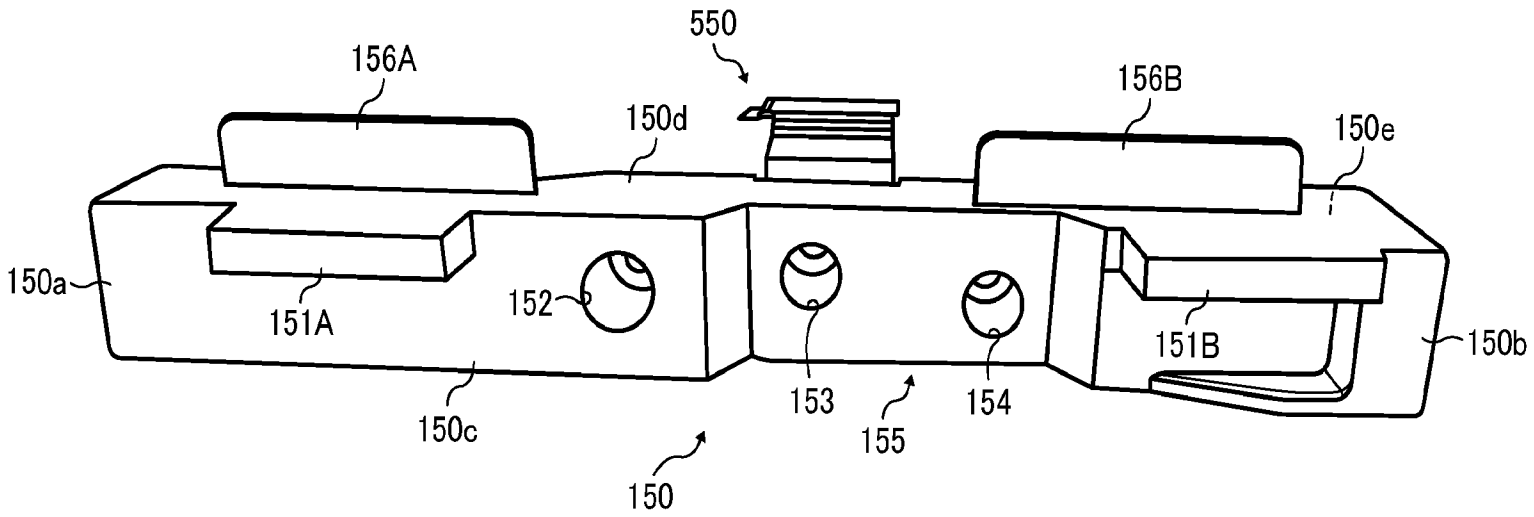
FIG. 28 is a perspective view schematically illustrating the cover and the belt pressing device constituting as a single unit as viewed from the proximal side according to another illustrative embodiment of the present disclosure.

As illustrated in FIGS. 25, 26, and 28, the inner cover 150 extends in the left-right direction or horizontally, and handles 151A and 151B are formed at both ends 150*a* and 150*b* in a longitudinal direction and in a projecting manner towards the proximal side of the main body.

Positioning holes 152 and 154, and an mounting hole 153 A are formed in a front surface 150*c* of the inner cover 150 serially in the longitudinal direction of the inner cover 150. The front surface 150*c* of the inner cover 150 is situated at the proximal side of the main body. The positioning holes 152 and 154, and the mounting hole 153 are formed in the front surface 150*c* of the inner cover 150, penetrating through a back surface 150*e* facing the lateral plate 521. The mounting hole 153 formed substantially at the center of the front surface 150*c* is formed to face a screw hole 563 formed in the lateral plate 521 when the inner cover 150 is mounted on the lateral plate 521. The mounting hole 153 allows a fastening member 159 to be fastened to the screw hole 563.

The positioning holes 152 and 154 are formed to face the pins 561 and 562 formed on the lateral plate 521, respectively, when the inner cover 150 is mounted on the lateral plate 521. The positioning holes 152 and 154 serve as positioning holes to position the belt pressing member 550 in place relative to the lateral plate 521.

The front surface 150*c* of the inner cover 150 includes a lever composition portion 155 which is concave toward the back surface 150*e*. The mounting hole 153 and the positioning hole 154 are formed in the lever composition portion 155. When the manual lever 844 is rotated in the lock direction B1, the manual lever 844 is situated at the lever composition portion 155 as illustrated in FIG. 25. The manual lever 844 and the inner cover 150 face each other at the lever composition portion 155 to prevent the inner cover 150 from getting detached from the lateral plate 521 toward the proximal side of the main body.

An upper surface 150*d* of the inner cover 150 includes stoppers 156A and 156B which are planar and project upward in FIG. 25. In the installed state in which the inner cover 150 is mounted on the lateral plate 521, the stoppers 156A and 156B overlap with each other as viewed from the proximal side of the main body (in the axial direction of the photoconductor). In FIG. 25, the photoconductor 40Bk and the stopper 156B face each other and overlap with each other as viewed from the proximal side of the main body. Two stoppers, i.e., the stoppers 156A and 156B are formed to allow the inner cover 150 to be utilized as common parts by a different main body 100. For example, when using the inner cover 150 in a four-color image forming apparatus without the special color toner or when using a photoconductor having a large diameter, the interval between the photoconductors may be different from that of the present illustrative embodiment of the present disclosure. Consequently, the stopper 156A may face the photoconductor.

In terms of sharing common parts, preferably, the stopper 156A and 156B are formed. In a case in which the inner cover 150 is utilized by one image forming apparatus, the inner cover 150 includes one of the stoppers 156A and 156B at a position facing the photoconductor 40Bk.

The photoconductor 40Bk is detachably mountable relative to the main body 100 from the lateral plate 521 side at which the inner cover 150 is disposed (from the proximal side of the main body) in the longitudinal direction (from a perpendicular direction relative to the drawing surface). Accordingly, in the installed state in which the inner cover 150 is mounted on the lateral plate 521, the stoppers 156A and 156B prevent the photoconductor 40Bk from moving in the separation direction. With this configuration, in the installed state in which the inner cover 150 is mounted on the lateral plate 521, even when the photoconductor 40Bk is pulled in the separation direction such that the photoconductor 40 Bk separates from the main body 100, the photoconductor 40Bk contacts the planar stoppers 156A and 156B of the inner cover 150, hence preventing erroneous operation.

Figure 29:
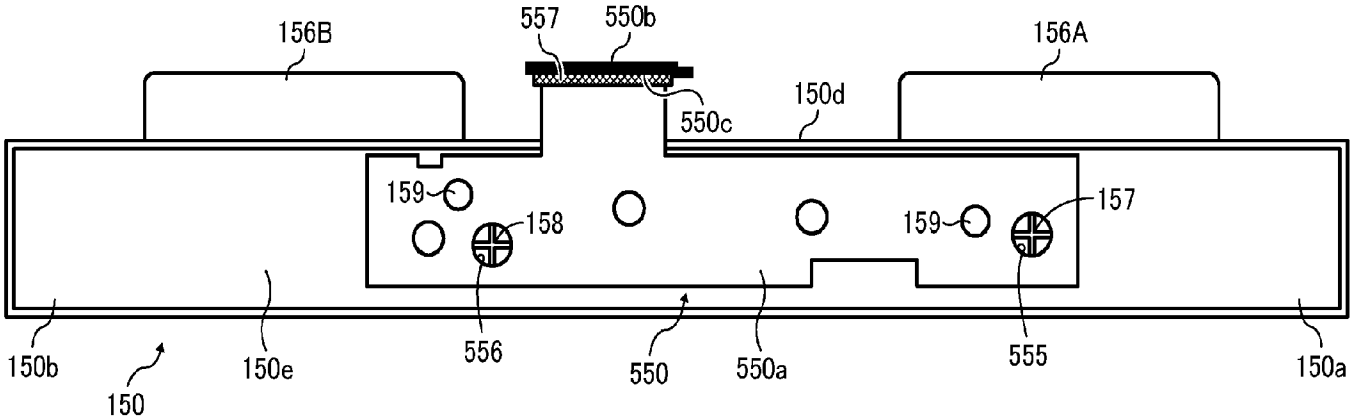
FIG. 29 is a side view schematically illustrating the cover and the belt pressing device constituting a single integrated unit as viewed from the distal side.

As illustrated in FIG. 29, the back surface 150*e* of the inner cover 150, which is an opposing plane, includes bosses 555 and 556. The bosses 555 and 556 are formed in a projecting manner from the back surface 150*e* toward the lateral plate 521, and are spaced a part a distance in the longitudinal direction of the inner cover 150. By inserting the bosses 555 and 556 into holes 157 and 158 formed in the belt pressing member 550, the inner cover 150 and the belt pressing member 550 are positioned in place. The dimensions of the bosses 555 and 556, and the holes 157 and 158 are formed with dimensional tolerance such that when the bosses 555 and 556 are inserted into the holes 157 and 158 there is no clearance therebetween. The belt pressing member 550 is fixed to the inner cover 150 by the plurality of fastening members 159 in a state in which the belt pressing member 550 is positioned in place relative to the back surface 150*e* of the inner cover 150.

The belt pressing member 550 is formed of a metal planar member which is bent into a substantially L-shape. One side of the belt pressing member 550, that is, a side surface 550*a*, is positioned in place relative to the back surface 150*e* of the inner cover 150 by the bosses 555 and 556. The other side of the belt pressing member 550, that is, an upper portion 550*b*, projects towards the lateral plate 521 from the back surface 150*e* of the inner cover 150. The upper portion 550*b* is situated above the upper surface 150*d* of the inner cover 150 when the belt pressing member 550 is fixed to the inner cover 150. Furthermore, when the inner cover 150 is fixed to the lateral plate 521, the upper portion 550*b* is situated above the belt surface 510*a* of the transfer belt 510. The surface of the upper portion 550*b* facing the belt surface 510*a* of the transfer belt 510 includes a pressing surface 550*c* that contacts the belt surface 510*a* to prevent the transfer belt 510 from moving upward. According to the present illustrative embodiment, since the belt pressing member 550 is formed of a metal planar member, an elastic member 557 is attached to the belt pressing member 550 to protect the belt surface 510*a* when the belt pressing member 550 contacts the belt surface 510*a* of the transfer belt 510. That is, the pressing surface 550*c* is disposed such that the pressing surface 550*c* can contact the belt surface 510*a* of the transfer belt 510 via the elastic member 557.

If the inner cover 150 is fixed to the lateral plate 521, the belt pressing member 550, the inner cover 150, the lateral plate 521, the bracket 533 of scale unit 530, and the scale mark detectors 531A and 531B are assembled, thereby adding up tolerances. In view of the above, according to the present illustrative embodiment, accumulation of the tolerances can be reduced by attaching the belt pressing member 550 to the inner cover 150.

Furthermore, since the belt pressing member 550 is attached and fixed to the inner cover 150 which is detachably mountable relative to the lateral plate 521, detachment of the inner cover 150 from the lateral plate 521 enables the belt pressing member 550 to separate from the lateral plate 521. With this configuration, operability upon replacement of the transfer belt 510 is enhanced.

According to the present illustrative embodiment, when the transfer belt 510 is in contact with the photoconductor 40Bk by the contact-and-separation device 800, the belt pressing member 550 is prevented from separating from the lateral plate 521 by the manual lever 844 serving as a stopper. When the transfer belt 510 is separated from the photoconductor 40Bk, the belt pressing member 550 becomes detachable from the lateral plate 521, thereby preventing interference between the transfer belt 510 and the belt pressing member 550 when the transfer unit 500 is detached from the main body 100. With this configuration, the operability upon replacement of the transfer unit 500 is enhanced while keeping the transfer belt 510 from damage and hence increasing the durability of the transfer belt 510.

The belt pressing member 550 is disposed opposite to the detection surfaces of the scale mark detectors 531A and 531B of the scale unit 530 to be detected. With this configuration, vibration of the transfer belt 510 is prevented upon detection of the scale marks M by the scale mark detectors 531A and 531B. Accordingly, the distance between the scale marks M and the scale mark detectors 531A and 531B does not fluctuate, thereby enhancing reliably detection accuracy.

According to the present illustrative embodiment, the belt pressing member 550 and the scale unit 530 are disposed such that the position of the transfer belt 510 in the black mode does not change. With this configuration, the transfer belt 510 is prevented from deformation or bending in the black mode.

Although the embodiments of the present disclosure have been described above, the present disclosure is not limited to the embodiments described above, but a variety of modifications can naturally be made within the scope of the present disclosure.

For example, the description has been provided of the image forming apparatus and the transfer unit equipped with the process cartridges of five different colors, i.e., black, cyan, magenta, yellow, and the special color. However, the present disclosure is not limited thereto. The present disclosure can be applied to an image forming apparatus and a transfer unit without the process cartridge for the special color. More specifically, the present disclosure can be applied to the image forming apparatus equipped with the process cartridges and the transfer unit associated with the colors yellow, magenta, cyan, and black, but without the process cartridge 18S and the primary transfer roller 14S associated with the special color, and the respective contact-and-separation device.

In this case, the contact-and-separation device 600 is employed for the primary transfer rollers 14Y, 14M, and 14C for the colors yellow, magenta, and cyan, instead of the contact-and-separation device 700.

According to the present illustrative embodiment, the belt pressing member 550 is disposed opposite to the detection surfaces of the scale mark detectors 531A and 531B of the scale unit 530 to be detected, and the transfer belt 510 contacts the scale mark detectors 531A and 531B. Alternatively, in some embodiments, the belt pressing member is not disposed opposite to the scale unit 530, but the belt pressing member prevents vibration and drifting of the transfer belt 510 without the scale unit 530.

According to the present illustrative embodiment, the transfer unit 500 employs the transfer belt 510 as the intermediate transfer belt onto which the toner image is transferred. The transfer unit is not limited thereto. For example, the transfer unit may employ a belt which is disposed opposite to the image bearer and delivers the recording medium P to the transfer portion formed between the recording medium P and the image bearer.

Figure 30:
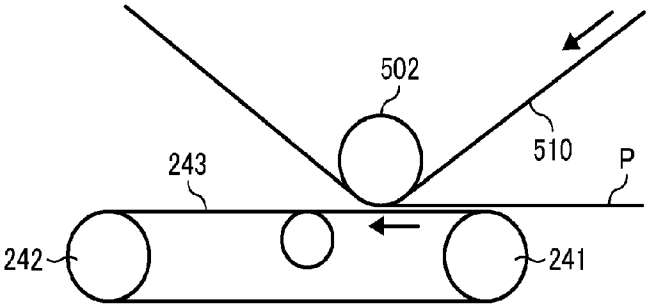
FIG. 30 is a schematic diagram illustrating another example of a secondary transfer unit.

Alternatively, as illustrated in FIG. 30, a secondary transfer belt 243 formed into an endless loop looped around a plurality of support rollers, i.e., rollers 241 and 242 may be employed as a secondary transfer device, instead of the secondary transfer roller 523. The secondary transfer belt 243 is rotated by the rollers 241 and 242. In this case, vibration of the secondary transfer belt 243 is suppressed by using at least the belt pressing member 550. Furthermore, the secondary transfer belt 243 may include the scale marks M, and the belt pressing member 550 is disposed opposite to the scale mark M.

According to the illustrative embodiments, the belt and the belt pressing member are prevented from interfering with each other when the transfer unit is detached from the image forming apparatus.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A transfer unit detachably mountable relative to an image forming apparatus having an image bearer that bears a toner image, comprising:

a plurality of rotational supports;

an endless-looped belt disposed opposite to the image bearer and movably supported by the plurality of rotational supports, to contact the image bearer to form a transfer portion at which the toner image is transferred;

a contact-and-separation device to move the belt to contact and separate from the image bearer;

a base to support the plurality of rotational supports;

a belt pressing member disposed facing the belt and detachably mountable relative to the base, to contact an end portion of the belt; and a first stopper to prevent the belt pressing member from separating from the base while the belt is in contact with the image bearer by the contact-and-separation device and to allow the belt pressing member to separate from the base while the belt is separated from the image bearer.

2. The transfer unit according to claim 1, further comprising a detector to detect a scale mark formed on the belt, wherein the belt pressing member is disposed opposite to the detector.

3. The transfer unit according to claim 2, wherein the image forming apparatus includes a plurality of image bearers, one for each of toner images of black and colors other than black, wherein the belt contacts the plurality of image bearers upon transfer of the toner images of black and the colors other than black in a full-color mode, and the belt contacts only a black image bearer of the plurality of image bearers that bears a black toner image upon transfer of only the black toner image in a black mode, wherein in the black mode the belt pressing member and the detector are situated at a position at which a position of the belt does not change.

4. The transfer unit according to claim 3, wherein the detector is disposed upstream from a black transfer portion in a traveling direction of the belt at which the belt contacts the black image bearer to transfer the black toner image onto the belt and is disposed downstream from an arbitrary rotational support among the plurality of rotational supports in the traveling direction of the belt, the arbitrary rotational support being disposed upstream from the black transfer portion.

5. The transfer unit according to claim 3, wherein the belt contacts in an arbitrary mode only an arbitrary image bearer of the plurality of image bearers that bears a toner image not used in the full-color mode, and in the arbitrary mode the belt pressing member and the detector are movable independently of each other.

6. The transfer unit according to claim 2, wherein the detector is movable by the contact-and-separation device such that the detector contacts and separates from the belt.

7. The transfer unit according to claim 2, further comprising a plurality of bases to support ends of the plurality of rotational supports in a longitudinal direction of the plurality of rotational supports, wherein one of the plurality of bases supports the detector, and the belt pressing member is positioned in place relative to the one of the plurality of bases.

8. The transfer unit according to claim 7, further comprising a rotatable bracket supported by the one of the plurality of bases.

9. The transfer unit according to claim 1, wherein the first stopper is a lever rotatably supported by the base, and a portion of the first stopper is connected to the contact-and-separation device.

10. The transfer unit according to claim 1, further comprising a cover detachably attachable relative to a main body of the image forming apparatus, to cover a portion of the transfer unit, wherein the transfer unit is mounted in the main body of the image forming apparatus, and the belt pressing member is disposed on the cover.

11. The transfer unit according to claim 10, wherein the contact-and-separation device includes a drive source and a plurality of gears to transmit a drive force from the drive source, and the cover covers at least one of the plurality of gears.

12. The transfer unit according to claim 10, wherein the image bearer is detachably mountable in the longitudinal direction of the image bearer relative to the main body from a side at which the cover is disposed, and the cover includes a second stopper to prevent the image bearer from separating in an installed state in which the cover is mounted in the main body.

13. The transfer unit according to claim 10, wherein the cover includes a positioning hole to position the belt pressing member in place relative to the base and a mounting hole that allows a fastening member to be fastened to a screw hole formed in the base from the cover at a separation direction side of the cover.

14. An image forming apparatus, comprising:

an image bearer to bear a toner image; and the transfer unit according to claim 1 to transfer the toner image borne on the image bearer to a transfer medium.

* * * * *